US010400761B2

(12) United States Patent
Robison et al.

(10) Patent No.: US 10,400,761 B2
(45) Date of Patent: Sep. 3, 2019

(54) LONG STROKE PUMPING UNIT

(71) Applicant: Weatherford Technology Holdings, LLC, Houston, TX (US)

(72) Inventors: Clark E. Robison, Tomball, TX (US); Benson Thomas, Pearland, TX (US); William Kevin Hall, Katy, TX (US); Sean M. Christian, Sparrows Point, MD (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 153 days.

(21) Appl. No.: 15/011,330

(22) Filed: Jan. 29, 2016

(65) Prior Publication Data

US 2016/0222957 A1 Aug. 4, 2016

Related U.S. Application Data

(60) Provisional application No. 62/121,821, filed on Feb. 27, 2015, provisional application No. 62/114,892,
(Continued)

(51) Int. Cl.
*F04B 47/14* (2006.01)
*F04B 49/20* (2006.01)
(Continued)

(52) U.S. Cl.
CPC ..... *F04B 49/20* (2013.01); *E21B 43/121* (2013.01); *E21B 43/127* (2013.01); *F04B 17/03* (2013.01);
(Continued)

(58) Field of Classification Search
CPC . E21B 43/121; E21B 43/127; E21B 2043/125
(Continued)

(56) References Cited

U.S. PATENT DOCUMENTS 2,683,379 A 7/1954 Strandgren
3,917,092 A 11/1975 McGinnis
(Continued)

FOREIGN PATENT DOCUMENTS

CN 2412105 Y 12/2000
CN 201810278 U 4/2011
(Continued)

OTHER PUBLICATIONS

PCT International Search Report and Written Opinion dated Aug. 24, 2016, for International Application No. PCT/US2016/015838.
(Continued)

*Primary Examiner* — Taras P Bemko
(74) *Attorney, Agent, or Firm* — Patterson + Sheridan, LLP

(57) ABSTRACT

A long stroke pumping unit includes a tower, a counterweight assembly movable along the tower, a crown mounted atop the tower, and a drum supported by the crown and rotatable relative thereto. A belt has a first end connected to the counterweight assembly and a second end connectable to a rod string, and the belt extends over the drum. A linear electromagnetic motor is used to reciprocate the counterweight assembly along the tower. The linear electromagnetic motor includes a traveler mounted to an exterior of the counterweight assembly and a stator extending from a base of the tower to the crown and along a guide rail of the tower. The pumping unit further includes a sensor for detecting position of the counterweight assembly.

24 Claims, 22 Drawing Sheets

Related U.S. Application Data filed on Feb. 11, 2015, provisional application No. 62/112,250, filed on Feb. 5, 2015, provisional application No. 62/109,144, filed on Jan. 29, 2015.

(51) Int. Cl.

| | |
|---|---|
| ***E21B 43/12*** | (2006.01) |
| ***F04B 17/03*** | (2006.01) |
| ***F04B 47/02*** | (2006.01) |
| ***F04B 19/22*** | (2006.01) |

(52) U.S. Cl.

CPC ..... *F04B 19/22* (2013.01); *F04B 47/02* (2013.01); *F04B 47/022* (2013.01); *F04B 47/026* (2013.01); *F04B 47/14* (2013.01); *E21B 2043/125* (2013.01)

(58) Field of Classification Search

USPC ..... 166/75.11

See application file for complete search history.

(56) References Cited

U.S. PATENT DOCUMENTS

| | | | | |
|---|---|---|---|---|
| 4,599,046 | A * | 7/1986 | James | E21B 47/0007 417/44.1 |
| 4,647,050 | A | 3/1987 | Johnson | |
| 4,916,959 | A | 4/1990 | Lively | |
| 4,932,253 | A | 6/1990 | McCoy | |
| 5,018,350 | A | 5/1991 | Bender | |
| 5,020,640 | A | 6/1991 | Nederbragt | |
| 5,196,770 | A | 3/1993 | Champs et al. | |
| 5,385,514 | A | 1/1995 | Dawe | |
| 5,404,767 | A | 4/1995 | Sutherland | |
| 5,440,183 | A | 8/1995 | Denne | |
| 5,540,095 | A | 7/1996 | Sherman et al. | |
| 6,011,508 | A | 1/2000 | Perreault et al. | |
| 6,101,952 | A | 8/2000 | Thornton et al. | |
| 6,499,701 | B1 | 12/2002 | Thornton et al. | |
| 6,508,132 | B1 | 1/2003 | Lohr et al. | |
| 6,578,495 | B1 | 6/2003 | Yitts et al. | |
| 6,606,569 | B1 | 8/2003 | Potts | |
| 6,770,004 | B1 | 8/2004 | Lofgren et al. | |
| 6,851,476 | B2 | 2/2005 | Gray et al. | |
| 6,983,701 | B2 | 1/2006 | Thornton et al. | |
| 7,178,600 | B2 | 2/2007 | Luke et al. | |
| 7,290,476 | B1 | 11/2007 | Glasson | |
| 7,373,971 | B2 | 5/2008 | Montgomery | |
| 7,530,799 | B2 | 5/2009 | Smith | |
| 7,579,941 | B2 | 8/2009 | Cleveland et al. | |
| 7,857,043 | B2 | 12/2010 | Ali-Zada | |
| 8,036,829 | B2 | 10/2011 | Gibbs et al. | |
| 8,256,579 | B2 | 9/2012 | Jia | |
| 8,328,527 | B2 | 12/2012 | Ehimeakhe | |
| 8,616,134 | B2 | 12/2013 | King et al. | |
| 8,624,699 | B2 | 1/2014 | Hunter et al. | |
| 8,849,954 | B2 | 9/2014 | Kim | |
| 8,851,860 | B1 | 10/2014 | Mail | |
| 8,858,187 | B2 | 10/2014 | Lane | |
| 10,197,050 | B2 | 2/2019 | Robison et al. | |
| 2001/0021347 | A1 | 9/2001 | Mills | |
| 2005/0238496 | A1 * | 10/2005 | Mills | E21B 47/0007 417/42 |
| 2006/0024177 | A1 * | 2/2006 | Robison | F04B 47/04 417/390 |
| 2006/0233650 | A1 * | 10/2006 | Zhou | E21B 43/126 417/416 |
| 2008/0018603 | A1 | 1/2008 | Baraz et al. | |
| 2012/0020808 | A1 | 1/2012 | Lawson et al. | |
| 2012/0230841 | A1 | 9/2012 | Gregory et al. | |
| 2013/0038144 | A1 * | 2/2013 | McAleese | H02K 41/02 310/12.21 |
| 2013/0045116 | A1 | 2/2013 | Wang et al. | |
| 2013/0186638 | A1 | 7/2013 | Filippov et al. | |
| 2014/0069720 | A1 | 3/2014 | Gray | |
| 2014/0312716 | A1 | 10/2014 | Hunter et al. | |
| 2015/0292307 | A1 | 10/2015 | Best | |
| 2016/0201664 | A1 | 7/2016 | Robison et al. | |
| 2016/0245276 | A1 | 8/2016 | Robison et al. | |
| 2017/0204846 | A1 | 7/2017 | Robison et al. | |

FOREIGN PATENT DOCUMENTS

| | | | |
|---|---|---|---|
| WO | 02068788 | A2 | 9/2002 |
| WO | 2014/182272 | A1 | 11/2014 |

OTHER PUBLICATIONS

Weatherford; Rotaflex Long-Stroke Pumping Units; Artificial Lift Systems; date unknown; 17 total pages.

Analog Devices; Data Sheet; Precision ±1.7 g, ±5 g, ±18 g Single-/Dual-Axis iMEMS Accelerometer; 2004-2014; 16 total pages.

Dr. Richard Thornton; Elevator World; Linear Synchronous Motors for Elevators dated Sep. 2006; 2 total pages.

Weatherford; Production Optimization; Stainless Steel Polished-Rod Load Cell dated 2008; 2 total pages.

Wieler, et al.; Elevator World; Linear Synchronous Motor Elevators Become a Reality; dated May 2012; 4 total pages.

MagneMotion; LSM Elevators; White Paper dated 2013; 2 total pages.

Weatherford; Rotaflex Long-Stroke Pumping Units; Proven Technology for Deep, Challenging, and High-Volume Wells; dated 2014; 24 total pages.

U.S. Appl. No. 14/717,441 entitled Dart Detector for Wellbore Tubular Cementation in the name of Zippel, et al; 35 total pages; filed May 20, 2015.

* cited by examiner

LONG STROKE PUMPING UNIT

BACKGROUND OF THE DISCLOSURE

Field of the Disclosure

The present disclosure generally relates to a long stroke pumping unit. The long stroke pumping unit may be a linear electromagnetic motor driven long stroke pumping unit or a screw driven direct drive pumping unit.

Description of the Related Art

To obtain hydrocarbon fluids, a wellbore is drilled into the earth to intersect a productive formation. Upon reaching the productive formation, an artificial lift system is often necessary to carry production fluid (e.g., hydrocarbon fluid) from the productive formation to a wellhead located at a surface of the earth. A sucker rod lifting system is a common type of artificial lift system.

The sucker rod lifting system generally includes a surface drive mechanism, a sucker rod string, and a downhole pump. Fluid is brought to the surface of the wellbore by reciprocating pumping action of the drive mechanism attached to the rod string. Reciprocating pumping action moves a traveling valve on the pump, loading it on the down-stroke of the rod string and lifting fluid to the surface on the up-stroke of the rod string. A standing valve is typically located at the bottom of a barrel of the pump which prevents fluid from flowing back into the well formation after the pump barrel is filled and during the down-stroke of the rod string. The rod string provides the mechanical link of the drive mechanism at the surface to the pump downhole.

One such surface drive mechanism is known as a long stroke pumping unit. The long stroke pumping unit includes a rotary motor, a gear box reducer driven by the motor, a chain and carriage linking the reducer to a counterweight assembly, and a belt connecting the counterweight assembly to the rod string. The mechanical drive mechanism is not very responsive to speed changes of the rod string. Gear-driven pumping units possess inertia from previous motion so that it is difficult to stop the units or change the direction of rotation of the units quickly. Therefore, jarring (and resultant breaking/stretching) of the rod string results upon the turnaround unless the speed of the rod string during the up-stroke and down-stroke is greatly decreased at the end of the up-stroke and down-stroke, respectively. Decreasing of the speed of the rod string for such a great distance of the up-stroke and down-stroke decreases the speed of fluid pumping, thus increasing the cost of the well.

Should the sucker rod string fail, there is a potential that the counterweight assembly will free fall and damage various parts of the pumping unit as it crashes under the force of gravity. The sudden acceleration of the counterweight assembly may not be controllable using the existing long stroke pumping unit.

SUMMARY OF THE DISCLOSURE

The present disclosure generally relates to a linear electromagnetic motor driven long stroke pumping unit. In one embodiment, a long stroke pumping unit includes: a tower; a counterweight assembly movable along the tower; a crown mounted atop the tower; a drum supported by the crown and rotatable relative thereto; a belt having a first end connected to the counterweight assembly, extending over the drum, and having a second end connectable to a rod string; and a linear electromagnetic motor for reciprocating the counterweight assembly along the tower. The linear electromagnetic motor includes: a traveler mounted to an exterior of the counterweight assembly; and a stator extending from a base of the tower to the crown and along a guide rail of the tower. The pumping unit further includes a sensor for detecting position of the counterweight assembly.

In another embodiment, a long stroke pumping unit includes a tower; a counterweight assembly movable along the tower; a crown mounted atop the tower; a drum supported by the crown and rotatable relative thereto; a belt having a first end connected to the counterweight assembly, extending over the drum, and having a second end connectable to a rod string; a linear electromagnetic motor for reciprocating the counterweight assembly along the tower and includes a traveler mounted in an interior of the counterweight assembly and a stator extending from a base of the tower to the crown and extending through the interior of the counterweight assembly; and a sensor for detecting position of the counterweight assembly.

In another embodiment, a linear electromagnetic motor for a direct drive pumping unit includes a stator having a tubular housing having a flange for connection to a stuffing box, a spool disposed in the housing, a coil of wire wrapped around the spool, and a core sleeve surrounding the coil; and a traveler having a core extendable through a bore of the housing and having a thread formed at a lower end thereof for connection to a sucker rod string, a polished sleeve for engagement with a seal of the stuffing box and connected to the traveler core to form a chamber therebetween, permanent magnet rings disposed in and along the chamber, each ring surrounding the traveler core.

In another embodiment, a direct drive pumping unit includes a reciprocator for reciprocating a sucker rod string and having a tower for surrounding a wellhead, a polished rod connectable to the sucker rod string and having an inner thread open to a top thereof and extending along at least most of a length thereof, a screw shaft for extending into the polished rod and interacting with the inner thread, and a motor mounted to the tower, torsionally connected to the screw shaft, and operable to rotate the screw shaft relative to the polished rod; and a sensor for detecting position of the polished rod.

In another embodiment, a long stroke pumping unit includes a tower; a counterweight assembly movable along the tower; a crown mounted atop the tower; a belt having a first end connected to the counterweight assembly and having a second end connectable to a rod string; a prime mover for reciprocating the counterweight assembly along the tower; a sensor for detecting position of the counterweight assembly; a load cell for measuring force exerted on the rod string; a motor operable to adjust an effective weight of the counterweight assembly during reciprocation thereof along the tower; and a controller in data communication with the sensor and the load cell and operable to control the adjustment force exerted by the adjustment motor.

In another embodiment, a long stroke pumping unit includes a tower; a counterweight assembly movable along the tower; a crown mounted atop the tower; a drum supported by the crown and rotatable relative thereto; a belt having a first end connected to the counterweight assembly, extending over the drum, and having a second end connectable to a rod string; a first motor operable to lift the counterweight assembly along the tower; a second motor operable to lift the rod string; and a controller for operating the second motor during an upstroke of the rod string and for operating the first motor during a downstroke of the rod string.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
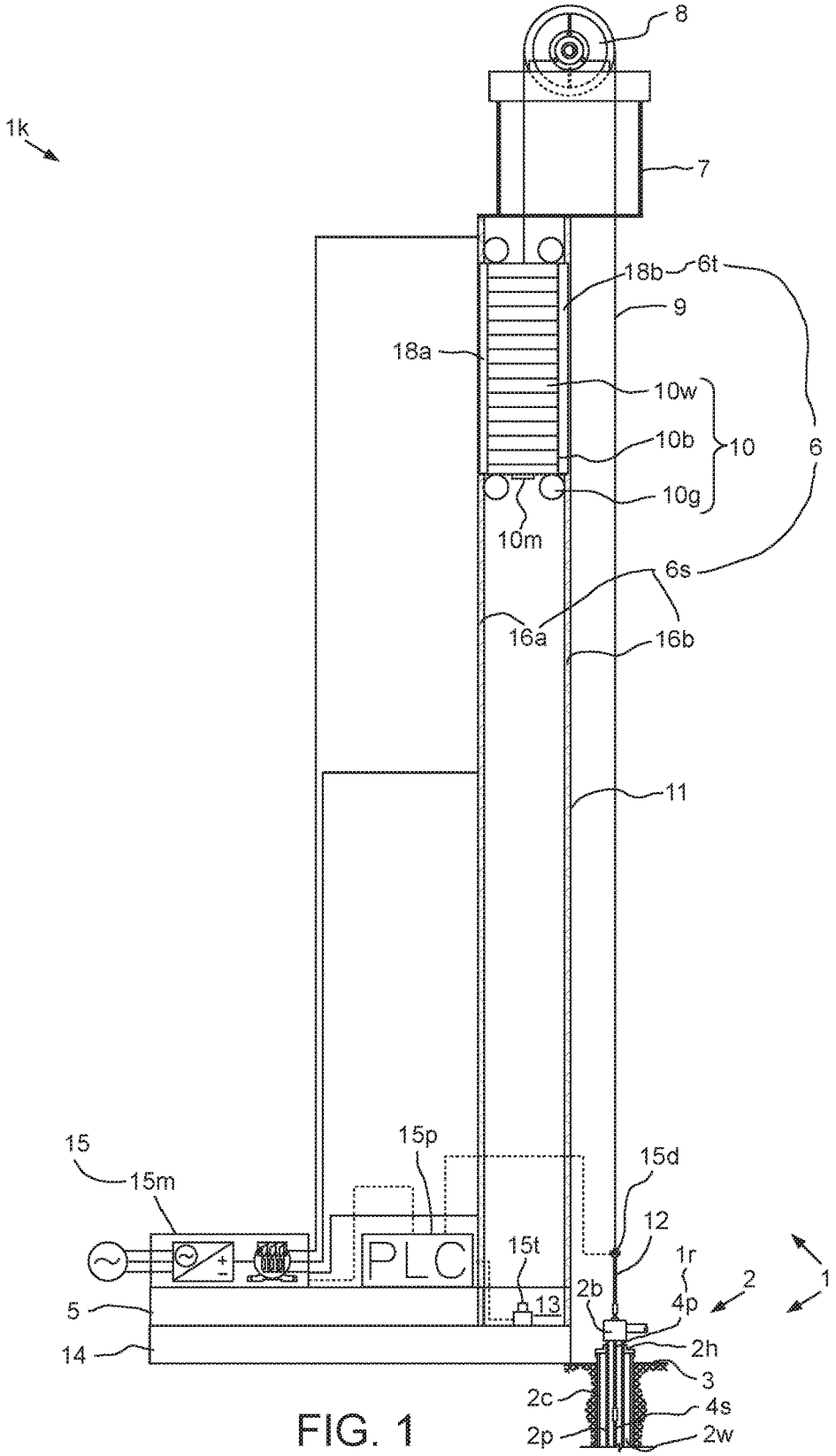
FIG. 1 illustrates a long stroke pumping unit, according to one embodiment of the present disclosure.

FIG. 1 illustrates a long stroke pumping unit 1*k*, according to one embodiment of the present disclosure. The long stroke pumping unit 1*k* may be part of an artificial lift system 1 further including a rod string 1*r* and a downhole pump (not shown). The artificial lift system 1 may be operable to pump production fluid (not shown) from a hydrocarbon bearing formation (not shown) intersected by a well 2. The well 2 may include a wellhead 2*h* located adjacent to a surface 3 of the earth and a wellbore 2*w* extending from the wellhead. The wellbore 2*w* may extend from the surface 3 through a non-productive formation and through the hydrocarbon-bearing formation (aka reservoir).

A casing string 2*c* may extend from the wellhead 2*h* into the wellbore 2*w* and be sealed therein with cement (not shown). A production string 2*p* may extend from the wellhead 2*h* and into the wellbore 2*w*. The production string 2*p* may include a string of production tubing and the downhole pump connected to a bottom of the production tubing. The production tubing may be hung from the wellhead 2*h*.

The downhole pump may include a tubular barrel with a standing valve located at the bottom that allows production fluid to enter from the wellbore 2*w*, but does not allow the fluid to leave. Inside the pump barrel may be a close-fitting hollow plunger with a traveling valve located at the top. The traveling valve may allow fluid to move from below the plunger to the production tubing above and may not allow fluid to return from the tubing to the pump barrel below the plunger. The plunger may be connected to a bottom of the rod string 1*r* for reciprocation thereby. During the upstroke of the plunger, the traveling valve may be closed and any fluid above the plunger in the production tubing may be lifted towards the surface 3. Meanwhile, the standing valve may open and allow fluid to enter the pump barrel from the wellbore 2*w*. During the downstroke of the plunger, the traveling valve may be open and the standing valve may be closed to transfer the fluid from the pump barrel to the plunger.

The rod string 1*r* may extend from the long stroke pumping unit 1*k*, through the wellhead 2*h*, and into the wellbore 2*w*. The rod string 1*r* may include a jointed or continuous sucker rod string 4*s* and a polished rod 4*p*. The polished rod 4*p* may be connected to an upper end of the sucker rod string 4*s* and the pump plunger may be connected to a lower end of the sucker rod string, such as by threaded couplings.

A production tree (not shown) may be connected to an upper end of the wellhead 2*h* and a stuffing box 2*b* may be connected to an upper end of the production tree, such as by flanged connections. The polished rod 4*p* may extend through the stuffing box 2*b*. The stuffing box 2*b* may have a seal assembly (not shown) for sealing against an outer surface of the polished rod 4*p* while accommodating reciprocation of the rod string 1*r* relative to the stuffing box.

The long stroke pumping unit 1*k* may include a skid 5, a linear electromagnetic motor 6, one or more ladders and platforms (not shown), a standing strut (not shown), a crown 7, a drum assembly 8, a load belt 9, one or more wind guards (not shown), a counterweight assembly 10, a tower 11, a hanger bar 12, a tower base 13, a foundation 14, and a control system 15. The control system 15 may include a programmable logic controller (PLC) 15*p*, a motor driver 15*m*, a counterweight position sensor, such as a laser rangefinder 15*t*, and a load cell 15*d*. The foundation 14 may support the pumping unit 1*k* from the surface 3 and the skid 5 and tower base 13 may rest atop the foundation. The PLC 15*p* may be mounted to the skid 5 and/or the tower 11.

Alternatively, an application-specific integrated circuit (ASIC) or field-programmable gate array (FPGA) may be used as the controller in the control system 15 instead of the PLC 15*p*.

The counterweight assembly 10 may be disposed in the tower 11 and longitudinally movable relative thereto. The counterweight assembly 10 may include a box 10*b*, one or more counterweights 10*w* disposed in the box, and guide wheels 10*g*. Guide wheels 10*g* may be connected at each corner of the box 10*b* for engagement with respective guide rails 17 (FIG. 3A) of the tower 11, thereby transversely connecting the box to the tower. The box 10*b* may be loaded with counterweights 10*w* until a total balancing weight of the counterweight assembly 10 corresponds to the weight of the rod string 1*r* and/or the weight of the column of production fluid. The counterweight assembly 10 may further include a mirror 10*m* mounted to a bottom of the box 10*b* and in a line of sight of the laser rangefinder 15*t*.

The crown 7 may be a frame mounted atop the tower 11. The drum assembly 8 may include a drum, a shaft, one or more ribs connecting the drum to the shaft, one or more pillow blocks mounted to the crown 7, and one or more bearings for supporting the shaft from the pillow blocks while accommodating rotation of the shaft relative to the pillow blocks.

The load belt 9 may have a first end longitudinally connected to a top of the counterweight box 10*b*, such as by a hinge, and a second end longitudinally connected to the hanger bar 12, such as by wire rope. The load belt 9 may extend from the counterweight assembly 10 upward to the drum assembly 8, over an outer surface of the drum, and downward to the hanger bar 12. The hanger bar 12 may be connected to the polished rod 4*p*, such as by a rod clamp, and the load cell 15*d* may be disposed between the rod clamp and the hanger bar. The load cell 15*d* may measure tension in the rod string 1*r* and report the measurement to the PLC 15*p* via a data link.

The laser rangefinder 15*t* may be mounted in the tower base 13 and aimed at the mirror 10*m*. The laser rangefinder 15*t* may be in power and data communication with the PLC 15*p* via a cable. The PLC 15*p* may relay the position measurement of the counterweight assembly 10 to the motor driver 15*m* via a data link. The PLC 15*p* may also utilize measurements from the turns counter 15*t* to determine velocity of the counterweight assembly.

Alternatively, the counterweight position sensor may include a turns gear torsionally connected to the shaft of the drum assembly 8 and a proximity sensor connected one of the pillow blocks or crown 7 and located adjacent to the turns gear. In one embodiment, the turns gear may be in power and data communication with the PLC 15*p* or the motor driver 15*m* via a cable. The turns gear may be made from an electrically conductive metal or alloy and the proximity sensor may be inductive. The proximity sensor may include a transmitting coil, a receiving coil, an inverter for powering the transmitting coil, and a detector circuit connected to the receiving coil. A magnetic field generated by the transmitting coil may induce an eddy current in the turns gear. The magnetic field generated by the eddy current may be measured by the detector circuit and supplied to the motor driver 15*m*. The PLC 15*p* or the motor driver 15*m* may then convert the measurement to angular movement and determine a position of the counterweight assembly along the tower 11. The PLC 15*p* or the motor driver 15*m* may also utilize measurements from the turns gear to determine velocity of the counterweight assembly. Alternatively, the proximity sensor may be Hall effect, ultrasonic, or optical. Alternatively, the turns gear may include a gear box instead of a single turns gear to improve resolution.

Alternatively, the laser rangefinder 15*t* may be mounted on the crown 7 and the mirror 10*m* may be mounted to the top of the counterweight box 10*b*. Alternatively, the counterweight position sensor may be an ultrasonic rangefinder instead of the turns counter 15*t*. The ultrasonic rangefinder may include a series of units spaced along the tower 11 at increments within the operating range thereof. Each unit may include an ultrasonic transceiver (or separate transmitter and receiver pair) and may detect proximity of the counterweight box 10*b* when in the operating range. Alternatively, the counterweight position sensor may be a string potentiometer instead of the turns counter 15*t*. The potentiometer may include a wire connected to the counterweight box 10*b*, a spool having the wire coiled thereon and connected to the crown 7 or tower base 13, and a rotational sensor mounted to the spool and a torsion spring for maintaining tension in the wire. Alternatively, a linear variable differential transformer (LVDT) may be mounted to the counterweight box and a series of ferromagnetic targets may be disposed along the tower 11.

Alternatively, the counterweight position may be determined by the motor driver 15*m* having a voltmeter and/or ammeter in communication with each phase. At any given time, the motor driver 15*m* may drive only two of the stator phases and may use the voltmeter and/or ammeter to measure back electromotive force (EMF) in the idle phase. The motor driver 15*m* may then use the measured back EMF from the idle phase to determine the position of the counterweight assembly 10.

The linear electromagnetic motor 6 may be a one or more, such as three, phase motor. The linear electromagnetic motor 6 may include a stator 6*s* and a traveler 6*t*. The stator 6*s* may include a pair of units 16*a,b*. Each stator unit 16*a,b* may extend between the crown 7 and the tower base 13 and have ends connected thereto. Each stator unit 16*a,b* may be housed within a respective guide rail 17 of the tower 11. The traveler 6*t* may include a pair of units 18*a,b*. Each traveler unit 18*a,b* may be mounted to a respective side of the counterweight box 10*b*.

The motor driver 15*m* may be mounted to the skid 5 and be in electrical communication with the stator 6*s* via a power cable. The power cable may include a pair of conductors for each phase of the linear electromagnetic motor 6. The motor driver 15*m* may be variable speed including a rectifier and an inverter. The motor driver 15*m* may receive a three phase alternating current (AC) power signal from a three phase power source, such as a generator or transmission lines. The rectifier may convert the three phase AC power signal to a direct current (DC) power signal and the inverter may modulate the DC power signal to drive each phase of the stator 6*s* based on signals from the laser rangefinder 15*t* or turn gear and control signals from the PLC 15*p*.

Figure 2:
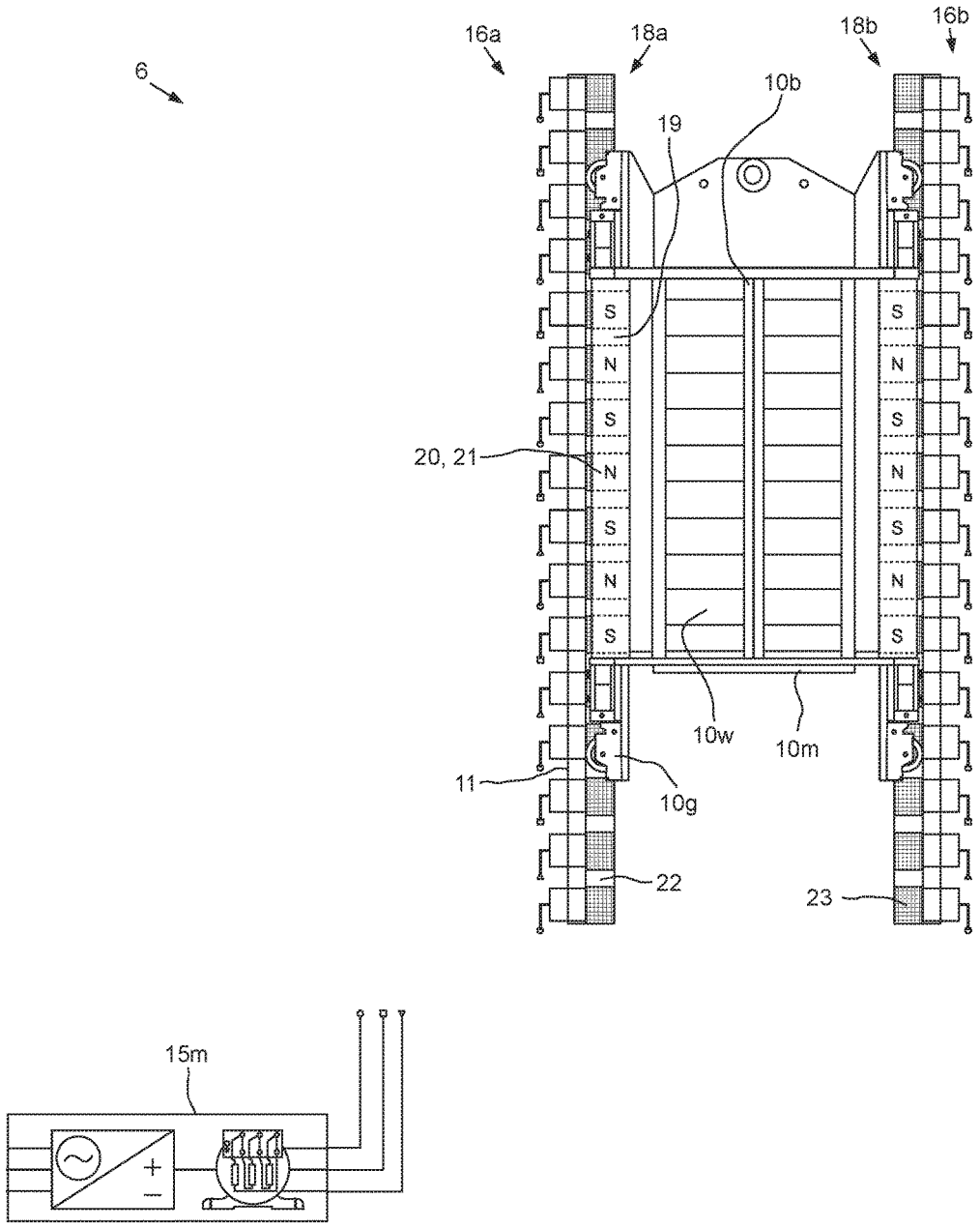
FIG. 2 illustrates a linear electromagnetic motor of the long stroke pumping unit.
Figure 3A:
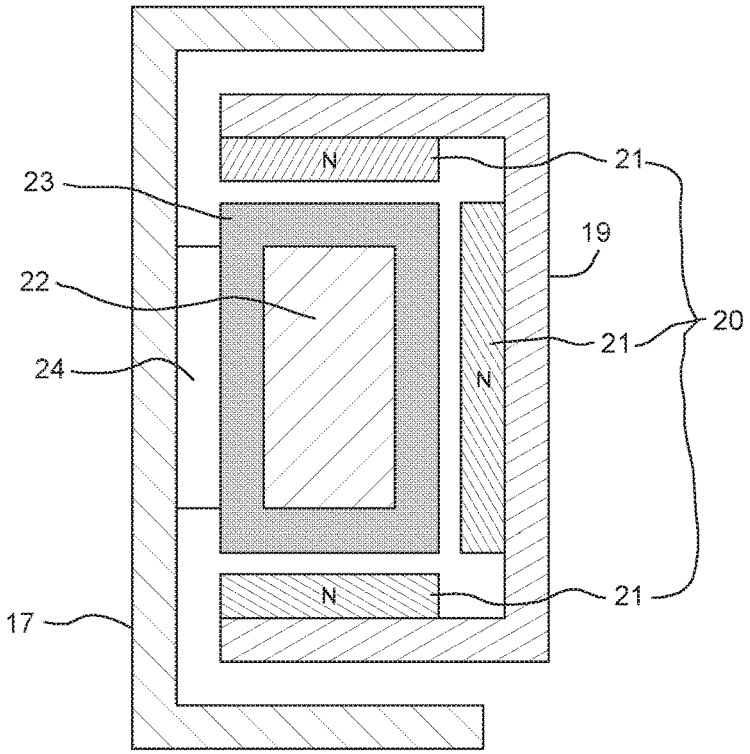
FIGS. 3A and 3B illustrate a traveler and stator of the linear electromagnetic motor.
Figure 3B:
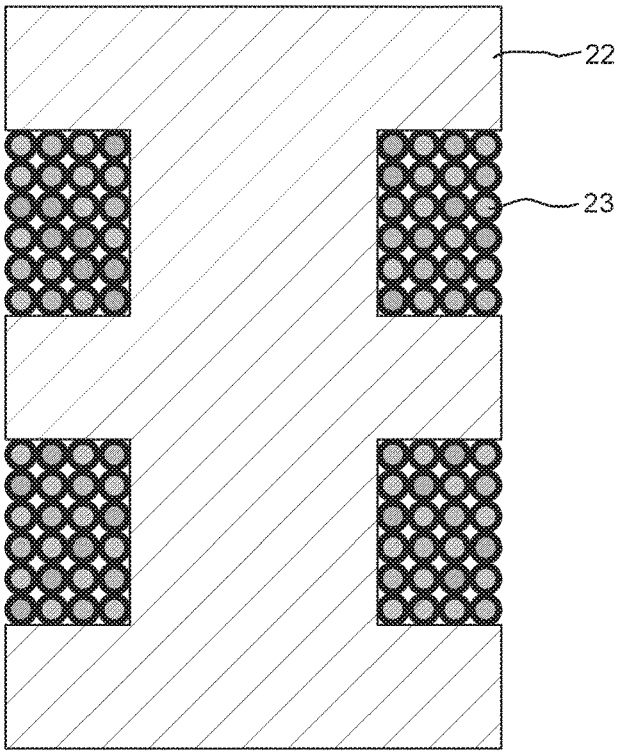

FIG. 2 illustrates the linear electromagnetic motor 6. FIGS. 3A and 3B illustrate the traveler 6*t* and stator 6*s*.

Each traveler unit 18*a,b* may include a traveler core 19 and a plurality of rows 20 of permanent magnets 21 connected to the traveler core, such as by fasteners (not shown). The traveler core 19 may be C-beam extending along the counterweight box 10*b* and be made from a ferromagnetic material, such as steel. Each row 20 may include a permanent magnet 21 connected to a respective inner face of the traveler core 19 such that the row surrounds three sides of the respective stator unit 16*a,b*. Each row 20 may be spaced along the traveler core 19 and each traveler unit 17*a,b* may include a sufficient number (seven shown) of rows to extend the length of the counterweight box 10*b*. A height of each row 20, defined by the height of the respective magnets 21, may correspond to a height of each coil 23 of the stator 6*s*. The polarization N,S of each row 20 may be oriented in the same cylindrically ordinate direction. Each adjacent row 20 may be oppositely polarized N,S.

Alternatively, the polarizations N,S of the rows 20 may be selected to concentrate the magnetic field of the traveler 6*t* at the periphery adjacent the stator 6*s* while canceling the magnetic field at an interior adjacent the traveler core 19 (aka Halbach array). Alternatively, the traveler core 19 may be made from a paramagnetic metal or alloy.

Each stator unit 16*a,b* may include a core 22, a plurality of coils 23, and a plurality of brackets 24. The stator core 22 may be a bar extending from the tower base 13 to the crown 7 and along the respective guide rail 17. The stator core 22 may have grooves spaced therealong for receiving a respective coil 23 and each stator unit 16*a,b* may have a sufficient number of coils for extending from the tower base 13 to the crown 7. The brackets may 24 may be disposed at each space between adjacent grooves in the stator core 22 and may fasten the stator core to the respective guide rail 17. The stator core 22 may be made from a ferromagnetic material of low electrical conductivity (or dielectric), such as electrical steel or soft magnetic composite. Each coil 23 may include a length of wire wound onto the stator core 22 and having a conductor and a jacket. Each conductor may be made from an electrically conductive metal or alloy, such as aluminum, copper, aluminum alloy, or copper alloy. Each jacket may be made from a dielectric and nonmagnetic material, such as a polymer. Ends of each coil 23 may be connected to a different pair of conductors of the power cable than adjacent coils thereto (depicted by the square, circle and triangle), thereby forming the three phases of the linear electromagnetic motor 6.

Alternatively, each stator core 22 may be a box instead of a bar.

Figure 4A:
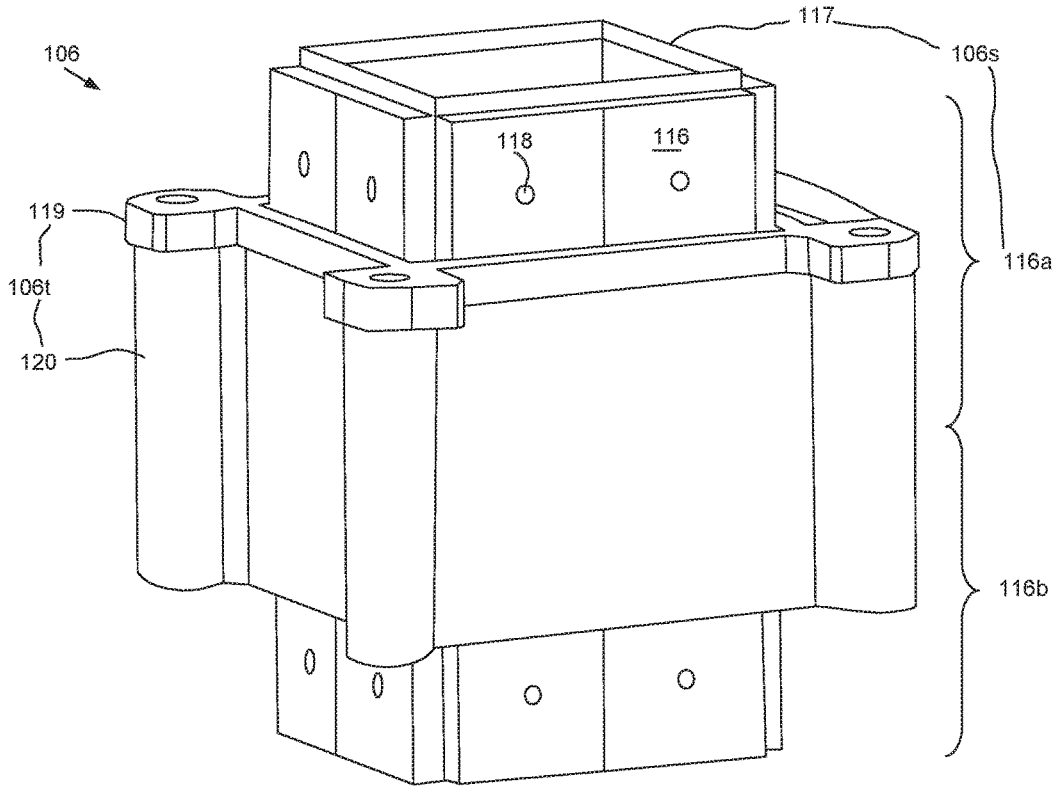
FIGS. 4A and 4B illustrate one phase of a linear electromagnetic motor of the long stroke pumping unit.
Figure 4B:
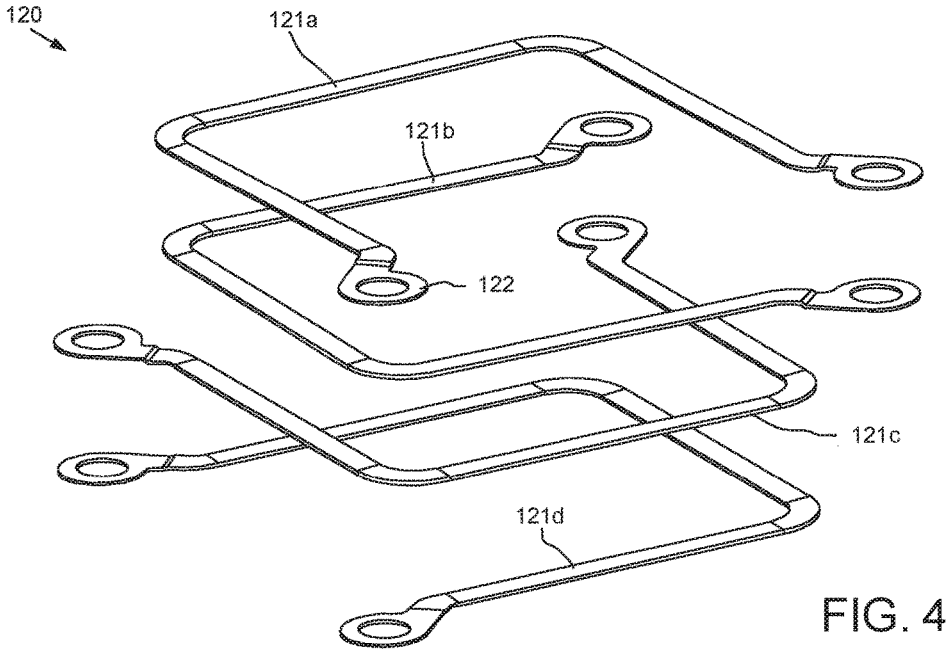

FIGS. 4A and 4B illustrate another embodiment of a linear electromagnetic motor 106 suitable for use with the long stroke pumping unit 1*k* of FIG. 1. In one embodiment, the linear electromagnetic motor 106 may be a one or more phase motor, such as a three phase motor. The linear electromagnetic motor 106 may include a stator 106*s* and a traveler 106*t*. The stator 106*s* may extend between the crown 7 and the tower base 13, may have ends connected thereto, and may extend through a longitudinal opening formed through an interior of the counterweight box 10*b*. The traveler 106*t* may be mounted to the counterweight box 10*b* adjacent to the longitudinal opening thereof.

The motor driver 15*m* may be mounted to the skid 5 and be in electrical communication with the stator 106*s* via a flexible power cable for accommodating reciprocation of the counterweight assembly 10 relative thereto. The power cable may include a pair of conductors for each phase of the linear electromagnetic motor 6. The motor driver 15*m* may supply actual position and speed of the traveler 106*t* to the PLC 15*p* for facilitating determination of control signals by the PLC.

FIGS. 4A and 4B illustrate one phase of the linear electromagnetic motor 106. The stator 106*s* may include a stator core 117 and rows 116*a,b* of permanent magnets 116 connected to the stator core, such as by fasteners 118. The stator core 117 may be a box extending from the tower base 13 to the crown 7. Each row 116*a,b* may include one or more (pair shown) adjacent permanent magnets 116 connected to a respective face of the stator core 117 (eight total if pair on each face) such that the row surrounds the periphery of the stator core. Each row 116*a,b* may be adjacently located along the stator core 117 and the stator 106*s* may include a sufficient number of rows 116*a,b* to extend from the tower base 13 to the crown 7. A height of each row 116*a,b*, defined by the height of the respective magnets 116, may correspond to a height of each phase of the traveler 106*t*. The polarization of each row 116*a,b* may be oriented in the same cylindrically ordinate direction. The polarizations of the rows 116*a,b* may be selected to concentrate the magnetic field of the stator 106*s* at the periphery adjacent the traveler 106*t* while canceling the magnetic field at an interior adjacent the stator core 117.

The traveler 106*t* may include a core 119 (only partially shown) and a coil 120 for each phase. Each coil 120 may include multiple flat coil segments 121*a-d* stacked together and electrically connected in series. Each segment 121*a-d* may be a flat, U-shaped piece of electrically conductive metal or alloy, such as aluminum, copper, aluminum alloy, or copper alloy. Each segment 121*a-d* may be jacketed by a dielectric material (not shown) and have non-jacketed connector ends, such as eyes 122. Each coil segment 121*a-d* may be rotated ninety degrees with respect to the coil segment it follows in the coil 120. Once a sufficient number of coil segments 121*a-d* have been stacked, each aligned set of eyes 122 (four shown) may be fastened together to form the coil 120 and the fasteners may also be used to connect the coil to the stator core 119. Due to the U-shape of the individual segments 121*a-d*, the coil 120 may have a rectangular-helical shape.

In operation, the linear electromagnetic motor 6 may be activated by the PLC 15*p* and operated by the motor driver 15*m* to reciprocate the counterweight assembly 10 along the tower 15. Reciprocation of the counterweight assembly 10 counter-reciprocates the rod string 1*r* via the load belt 9 connection to both members, thereby driving the downhole pump and lifting production fluid from the wellbore 2*w* to the wellhead 2*h*.

Should the PLC 15*p* detect failure of the rod string 1*r* by monitoring the laser rangefinder 15*t*, turn gear, and/or the load cell 15*d*, the PLC may instruct the motor driver 15*m* to operate the linear electromagnetic motor 6 to control the descent of the counterweight assembly 10 until the counterweight assembly reaches the tower base 13. The PLC 15*p* may then shut down the linear electromagnetic motor 6. The PLC 15*p* may be in data communication with a home office (not shown) via long distance telemetry (not shown). The PLC 15*p* may report failure of the rod string 1*r* to the home office so that a workover rig (not shown) may be dispatched to the well site to repair the rod string 1*r*.

Figure 5:
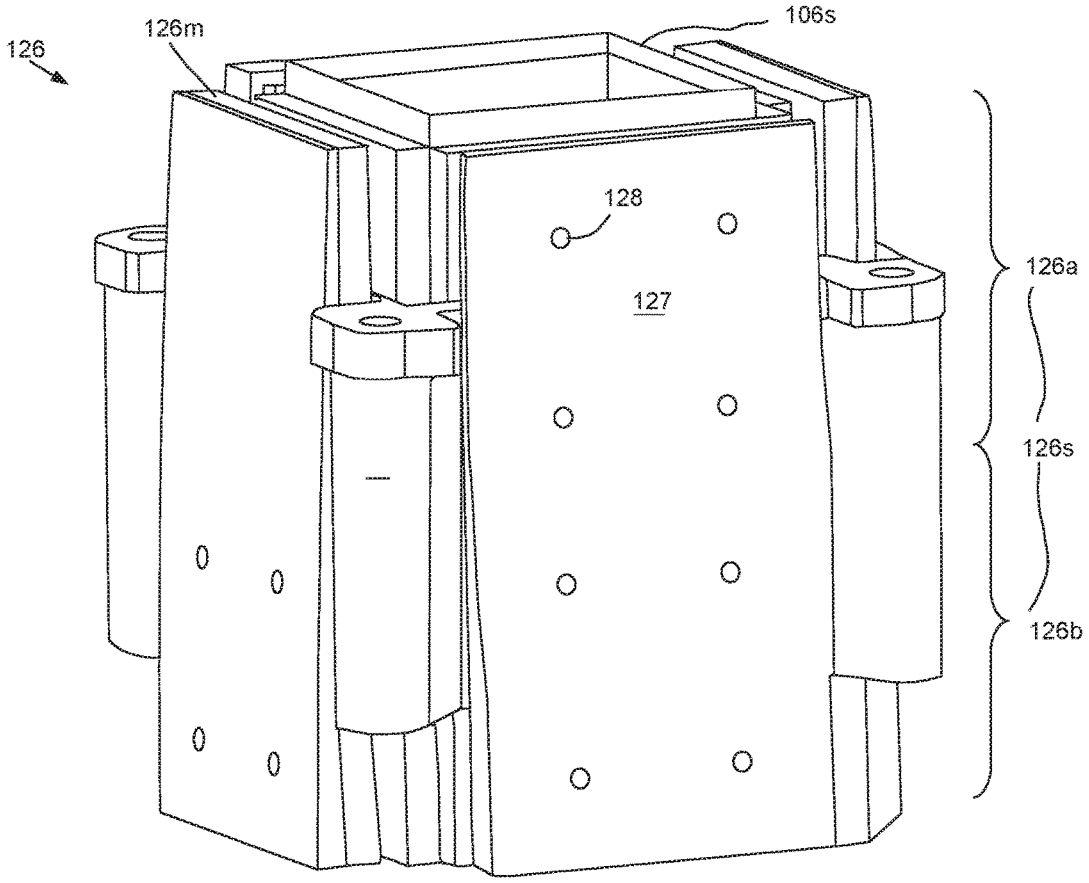
FIG. 5 illustrates one phase of an alternative linear electromagnetic motor for use with the long stroke pumping unit, according to another embodiment of the present disclosure.

FIG. 5 illustrates one phase of an alternative linear electromagnetic motor 126 for use with the long stroke pumping unit 1*k*, according to another embodiment of the present disclosure. The alternative linear electromagnetic motor 126 may include the traveler 106*t*, the (inner) stator 106*s*, and an outer stator 12106*s*. The outer stator 12106*s* may include a segment for each face of the inner stator 106*s*. Each segment may include may include a stator core 127 and permanent magnets 126*m* connected to the stator core, such as by fasteners 128. Each stator core 127 may be a plate extending from the tower base 13 to the crown 7. Cumulatively, the permanent magnets 126*m* of the segments may form rows 126*a,b* positioned to surround a periphery of the traveler 106*t*. Each row 126*a,b* may be adjacently located along the respective stator core 127 and the outer stator 12106*s* may include a sufficient number of rows 126*a,b* to extend from the tower base 13 to the crown 7. A height of each row 126*a,b* (defined by the height of the respective magnets 126*m*) may correspond to a height of each phase of the traveler 106*t*. The polarization of each row 126*a,b* may be oriented in the same cylindrically ordinate direction. The polarizations of the rows 126*a,b* may be selected to concentrate the magnetic field of the outer stator 12106*s* at the interior adjacent the periphery of the traveler 106*t* while canceling the magnetic field at a periphery of the outer stator.

Figure 6:
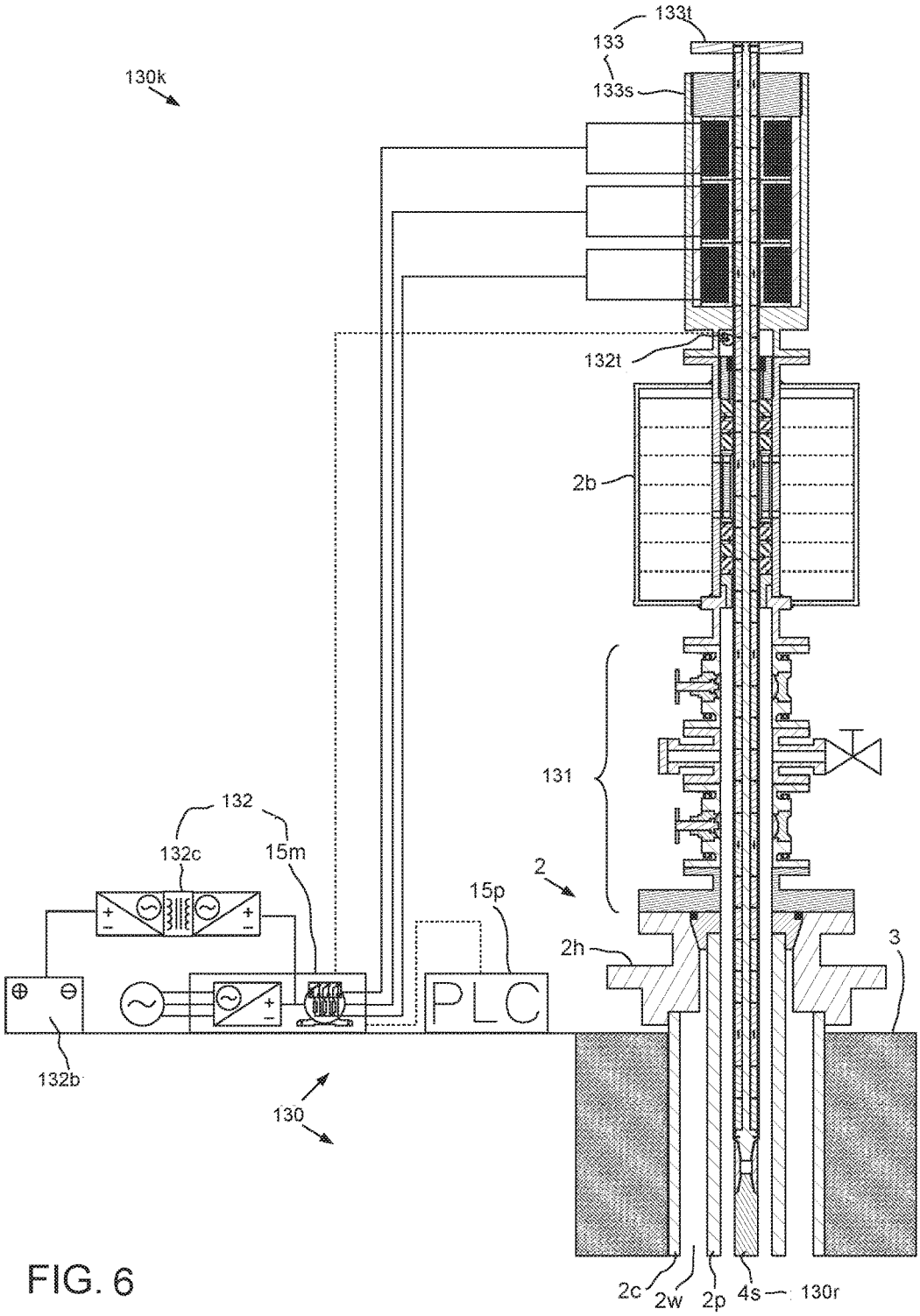
FIG. 6 illustrates a direct drive pumping unit having a linear electromagnetic motor mounted to the wellhead, according to another embodiment of the present disclosure.

FIG. 6 illustrates a direct drive pumping unit 130*k* having a linear electromagnetic motor 133 mounted to the wellhead 2*h*, according to another embodiment of the present disclosure. The direct drive pumping unit 130*k* may be part of an artificial lift system 130 further including a rod string 130*r* and the downhole pump (not shown). The artificial lift system 130 may be operable to pump production fluid (not shown) from a hydrocarbon bearing formation (not shown) intersected by the well 2. The rod string 130*r* may include the jointed or continuous sucker rod string 4*s* and a traveler 133*t* of the linear electromagnetic motor 133. The traveler 133*t* may be connected to an upper end of the sucker rod string 4*s* and the pump plunger may be connected to a lower end of the sucker rod string, such as by threaded couplings.

Figure 7:
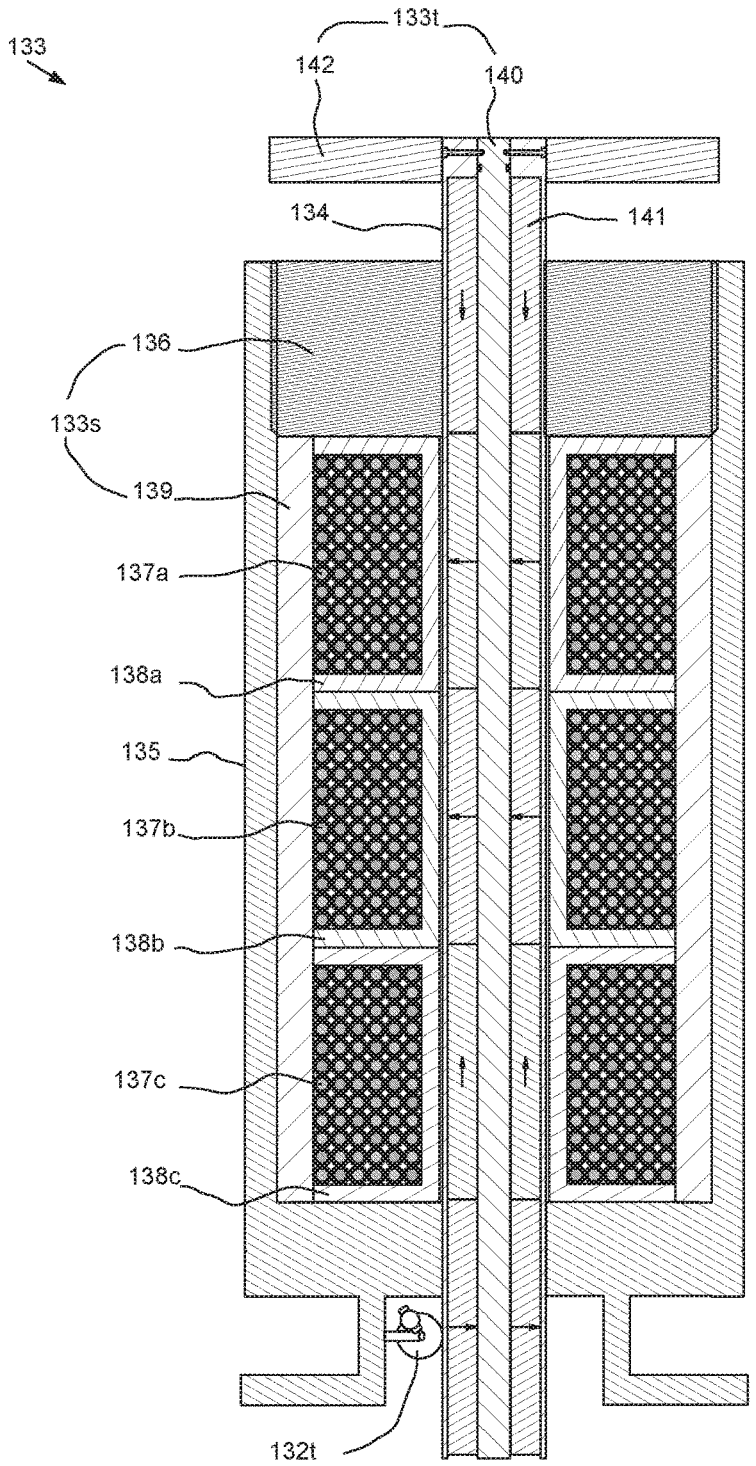
FIG. 7 illustrates the linear electromagnetic motor of the direct drive pumping unit.

The production tree 131 may be connected to an upper end of the wellhead 2*h* and the stuffing box 2*b* may be connected to an upper end of the production tree, such as by flanged connections. A stator 133*s* of the linear electromagnetic motor may be connected to an upper end of the stuffing box 2*b*, such as by a flanged connection. The stuffing box 2*b*, production tree 131, and wellhead 2*h* may be capable of supporting the stator 133*s* during lifting of the rod string 130*r* which may exert a considerable downward reaction force thereon, such as greater than or equal to ten thousand, twenty-five thousand, or fifty thousand pounds. The traveler 133*t* may extend through the stuffing box 2*b* and include a polished sleeve 134 (FIG. 7). The stuffing box 2*b* may have a seal assembly for sealing against an outer surface of the polished sleeve 134 while accommodating reciprocation of the rod string 130*r* relative to the stuffing box.

Alternatively, the stator 133*s* may be connected between the stuffing box 2*b* and the production tree 131 or between the production tree 131 and the wellhead 2*h*.

The direct drive pumping unit 130*k* may include a skid (not shown), the linear electromagnetic motor 133 and a control system 132. The control system 132 may include the PLC 15*p*, the motor driver 15*m*, a position sensor 132*t*, a power converter 132*c*, and a battery 132*b*. The power converter 132*c* may include a rectifier, a transformer, and an inverter for converting electric power generated by the linear electromagnetic 133 (via the motor driver 15*m*) on the downstroke to usable power for storage by the battery 132*b*. The battery 132*b* may then return the stored power to the motor driver 15*m* on the upstroke, thereby lessening the demand on the three phase power source.

The position sensor 132*t* may include a friction wheel, a shaft, one or more blocks, one or more bearings, and a turns counter. The turns counter may be in power and data communication with the motor driver 15*m* via a cable. The friction wheel may be biased into engagement with the polished sleeve 134 and supported for rotation relative to the blocks by the bearings. The blocks may be connected to the stator 133*s*. The turns counter may include a turns gear torsionally connected to the shaft and a proximity sensor connected to one of the blocks or stator 133*s* and located adjacent to the turns gear. The proximity sensor may be any of the sensors discussed above for the turns counter 15*t*.

Alternatively, any of the alternative counterweight position sensors discussed above may be adapted for use with the direct drive pumping system 130*k* instead of the position sensor 132*t*.

The linear electromagnetic motor 133 may be a one or more phase motor, such as a three phase motor. The linear electromagnetic motor 133 may include the stator 133*s* and a traveler 133*t*. The motor driver 15*m* may be mounted to the skid and be in electrical communication with the stator 133*s* via a power cable including a pair of conductors for each phase of the linear electromagnetic motor 133. The motor driver 15*m* may drive each phase of the stator 133*s* based on signals from the position sensor 132*t* and control signals from the PLC 15*p*. The motor driver 15*m* may also supply actual position and speed of the traveler 133*t* to the PLC 15*p* for facilitating determination of control signals by the PLC.

FIG. 7 illustrates the linear electromagnetic motor 133. The stator 133*s* may include a housing 135, a retainer, such as a nut 136, a coil 137*a-c* forming each phase of the stator, a spool 138*a-c* for each coil, and a core 139.

The housing 135 may be tubular, have a bore formed therethrough, have a flange formed at a lower end thereof for connection to the stuffing box 2*b*, and have an inner thread formed at an upper end thereof. The nut 136 may be screwed into the threaded end of the housing 135, thereby trapping the coils 137*a-c*, spools 138*a-c*, and core 139 between a shoulder formed in an inner surface of the housing and in a stator chamber formed in the housing inner surface. Each coil 137*a-c* may include a length of wire wound onto a respective spool 138*a-c* and having a conductor and a jacket. Each conductor may be made from an electrically conductive metal or alloy, such as aluminum, copper, aluminum alloy, or copper alloy. Each jacket may be made from a dielectric material. Each spool 138*a-c* may be made from a material having low magnetic permeability or being non-magnetic. The stator core 139 may be made from a magnetically permeable material. The coils 137*a-c* and spools 138*a-c* may be stacked in the stator chamber and the stator core 139 may be a sleeve extending along the stator chamber and surrounding the coils and spools.

Alternatively, the housing 135 may also have a flange formed at an upper end thereof or the nut 136 may have a flange formed at an upper end thereof.

The traveler 133*t* may include the polished sleeve 134, a core 140, permanent magnet rings 141, and a clamp 142. The traveler core 140 may be a rod having a thread formed at a lower end thereof for connection to the sucker rod string 4*s*. The traveler core 140 may be made from a magnetically permeable material. The polished sleeve 134 may extend along the traveler core 140 and be made from a material having low magnetic permeability or being non-magnetic. Each end of the polished sleeve 134 may be connected to the traveler core 140, such as by one or more (pair shown) fasteners. The traveler core 140 may have seal grooves formed at or adjacent to each end thereof and seals may be disposed in the seal grooves and engaged with an inner surface of the polished sleeve 134. The polished sleeve 134 may have an inner shoulder formed in an upper end thereof and the traveler core 140 may have an outer shoulder formed adjacent to the lower threaded end. A magnet chamber may be formed longitudinally between the shoulders and radially between an inner surface of the polished sleeve 134 and an outer surface of the traveler core 140. The permanent magnet rings 141 may be stacked along the magnet chamber.

Each permanent magnet ring 141 may be unitary and have a height corresponding to a height of each coil 137*a-c*. The polarizations of the permanent magnet rings 141 may be selected to concentrate the magnetic field of the traveler 133*t* at the periphery adjacent the stator 133*s* while canceling the magnetic field at an interior adjacent the traveler core 140. A length of the stack of permanent magnet rings 141 may define a stroke length of the direct drive pumping unit 130*k* and the traveler 133*t* may include a sufficient number of permanent magnet rings to be a long stroke, short-stroke, or medium-stroke pumping unit. The clamp 142 may be fastened to an upper end of the polished sleeve 134 and may engage the nut 136 to support the rod string 130*r* when the linear electromagnetic motor 133 is shut off.

Alternatively, each permanent magnet ring 141 may be made from a row of permanent magnet plates instead of being unitary. Alternatively, only the upper end of the polished sleeve 134 may be fastened to the traveler core 140. Alternatively, the traveler may include a sleeve disposed between the permanent magnet rings for serving as the core instead of the rod.

In operation, the linear electromagnetic motor 133 may be activated by the PLC 15*p* and operated by the motor driver 15*m* to reciprocate the rod string 130*r*, thereby driving the downhole pump and lifting production fluid from the wellbore 2*w* to the wellhead 2*h*.

Should the PLC 15*p* detect failure of the rod string 1*r* by monitoring the position sensor 132*t*, the PLC may shut down the linear electromagnetic motor 133. The PLC 15*p* may report failure of the rod string 1*r* to the home office so that a workover rig (not shown) may be dispatched to the well site to repair the rod string 130*r*.

Alternatively, the linear electromagnetic motor 133 may be used with the long stroke pumping unit 1*k* instead of linear electromagnetic motors 6, 106, 126. In this alternative, the stator 133*s* would be mounted in the counterweight box 10*b* (thereby becoming the traveler), and the traveler 133*t* would extend from the tower base 13 to the crown 7 (thereby becoming the stator). Alternatively, an application-specific integrated circuit (ASIC) or field-programmable gate array (FPGA) may be used as the controller in either or both control systems 15, 132 instead of the PLC 15*p*.

Figure 8:
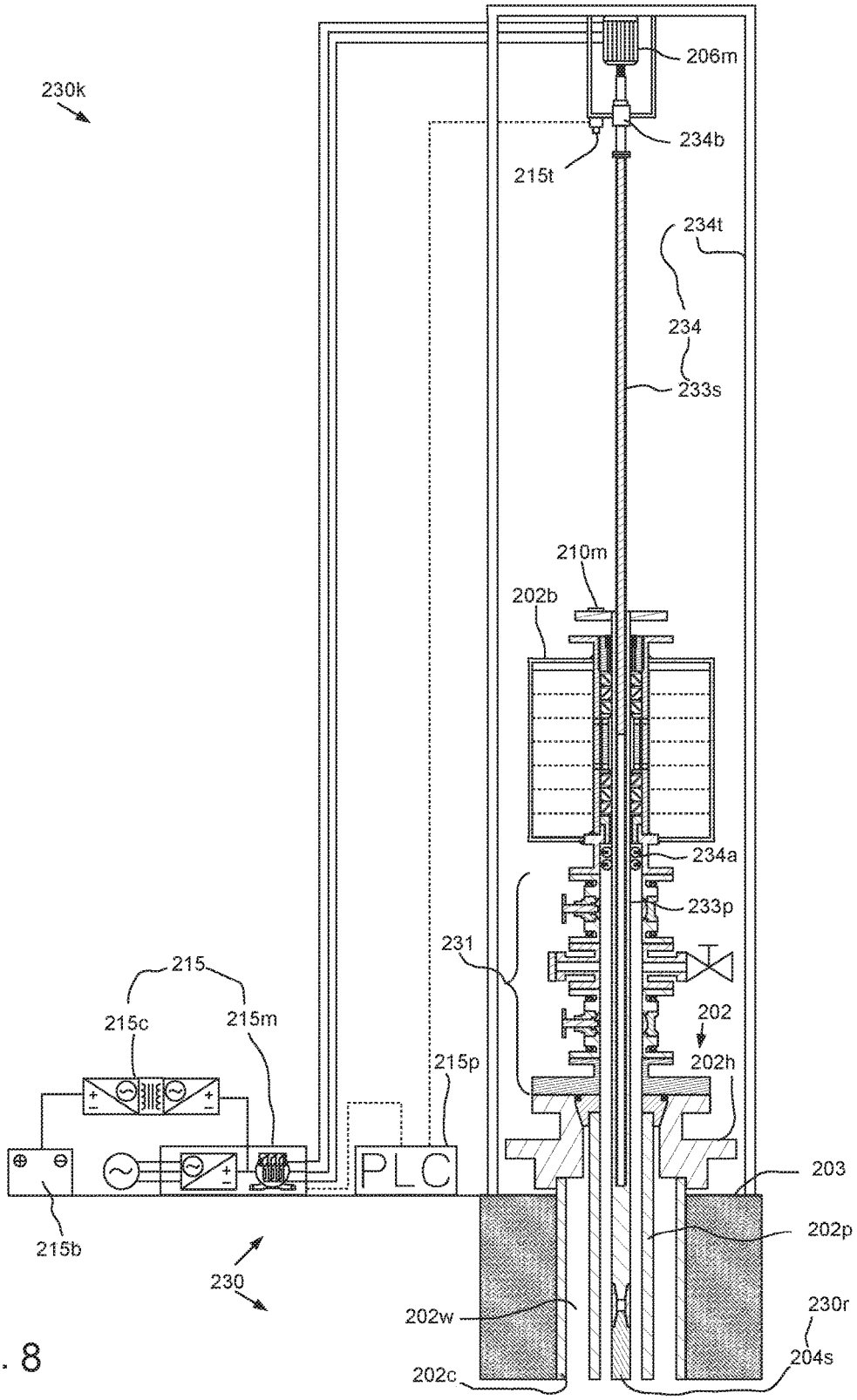
FIG. 8 illustrates a direct drive pumping unit, according to one embodiment of the present disclosure.

FIG. 8 illustrates a direct drive pumping unit 230*k*, according to one embodiment of the present disclosure. The direct drive pumping unit 230*k* may be part of an artificial lift system 230 further including a rod string 230*r* and a downhole pump (not shown). The artificial lift system 230 may be operable to pump production fluid (not shown) from a hydrocarbon bearing formation (not shown) intersected by a well 202. The well 202 may include a wellhead 202*h* located adjacent to a surface 203 of the earth and a wellbore 202*w* extending from the wellhead. The wellbore 202*w* may extend from the surface 203 through a non-productive formation and through the hydrocarbon-bearing formation (aka reservoir).

A casing string 202*c* may extend from the wellhead 202*h* into the wellbore 202*w* and be sealed therein with cement (not shown). A production string 202*p* may extend from the wellhead 202*h* and into the wellbore 202*w*. The production string 202*p* may include a string of production tubing and the downhole pump connected to a bottom of the production tubing. The production tubing may be hung from the wellhead 202*h*.

The downhole pump may include a tubular barrel with a standing valve located at the bottom that allows production fluid to enter from the wellbore 202*w*, but does not allow the fluid to leave. Inside the pump barrel may be a close-fitting hollow plunger with a traveling valve located at the top. The traveling valve may allow fluid to move from below the plunger to the production tubing above and may not allow fluid to return from the tubing to the pump barrel below the plunger. The plunger may be connected to a bottom of the rod string 230*r* for reciprocation thereby. During the upstroke of the plunger, the traveling valve may be closed and any fluid above the plunger in the production tubing may be lifted towards the surface 203. Meanwhile, the standing valve may open and allow fluid to enter the pump barrel from the wellbore 202*w*. During the downstroke of the plunger, the traveling valve may be open and the standing valve may be closed to transfer the fluid from the pump barrel to the plunger.

The rod string 230*r* may include the jointed or continuous sucker rod string 204*s* and a polished rod 233*p* of a lead screw 233. The polished rod 233*p* may be connected to an upper end of the sucker rod string 204*s* and the pump plunger may be connected to a lower end of the sucker rod string, such as by threaded couplings.

The production tree 231 may be connected to an upper end of the wellhead 202*h* and the stuffing box 202*b* may be connected to an upper end of the production tree, such as by flanged connections. The polished rod 233*p* may extend through the stuffing box 202*b* and the stuffing box may have a seal assembly for sealing against an outer surface of the polished rod while accommodating reciprocation of the rod string 230*r* relative to the stuffing box.

The direct drive pumping unit 230*k* may include a skid (not shown), a reciprocator 234, and the control system 215. The reciprocator 234 may include an electric motor 206*m*, the lead screw 233, a torsional arrestor 234*a*, a thrust bearing 234*b*, and a tower 234*t*. The tower 234*t* may extend from the surface 203 and surround the wellhead 202*h*, the production tree 231, and the stuffing box 202*b*. The tower 234*t* may extend upward past a top of the stuffing box 202*b* by a height corresponding to a stroke length of the direct drive pumping unit 230*k*. The tower 234*t* may be sized such that the direct drive pumping unit 230*k* is a long stroke, short-stroke, or medium-stroke pumping unit. A stator of the electric motor 206*m* may be mounted to a lower surface of a top of the tower 234*t*. The electric motor 206*m* may be an induction motor, a switched reluctance motor, or a brushless direct current motor.

The thrust bearing 234*b* may include a housing, a thrust shaft, a thrust runner, and a thrust carrier. The thrust shaft may be torsionally connected to the rotor of the electric motor 206*m* by a slide joint, such as splines formed at adjacent ends of the rotor and drive shaft. The thrust shaft may also be longitudinally and torsionally connected to an upper end of a screw shaft 233*s* of the lead screw 233, such as by a flanged connection. The thrust housing may be longitudinally and torsionally connected to the lower surface of the top of the tower 234*t* by a bracket and have lubricant, such as refined and/or synthetic oil, disposed therein. The thrust runner may be mounted on the thrust shaft and the thrust carrier may be mounted in the thrust housing. The thrust carrier may have two or more load pads formed in a face thereof adjacent the thrust runner for supporting weight of the screw shaft 233*s* and the rod string 230*r*.

The control system 215 may include a programmable logic controller (PLC) 215*p*, a motor driver 215*m*, a position sensor, such as a laser rangefinder 215*t*, a load cell 215*d*, a power converter 215*c*, and a battery 215*b*. Except for the laser rangefinder 215*t*, the control system 215 may be mounted to the skid. The laser rangefinder 215*t* may be mounted to the bracket of the thrust bearing 234*b* and aimed at a mirror 10*m*. The laser rangefinder 215*t* may be in power and data communication with the PLC 215*p* via a cable. The PLC 215*p* may relay the position measurement of the polished rod 233*p* to the motor driver 215*m* via a data link. The PLC 215*p* may also utilize measurements from the laser rangefinder 215*t* to determine velocity of the polished rod 233*p*.

Alternatively, an application-specific integrated circuit (ASIC) or field-programmable gate array (FPGA) may be used as the controller in the control system 215 instead of the PLC 215*p*. Alternatively, the laser rangefinder 215*t* may be mounted to the tower 234*t* instead of the bracket.

Alternatively, the position sensor may be an ultrasonic rangefinder instead of the laser rangefinder 215*t*. The ultrasonic rangefinder may include a series of units spaced along the tower 234*t* at increments within the operating range thereof. Each unit may include an ultrasonic transceiver (or separate transmitter and receiver pair) and may detect proximity of the polished rod 233*p* when in the operating range. Alternatively, the position sensor may be a string potentiometer instead of the laser rangefinder 215*t*. The potentiometer may include a wire connected to the polished rod 233*p*, a spool having the wire coiled thereon and connected to the bracket or tower 234*t*, and a rotational sensor mounted to the spool and a torsion spring for maintaining tension in the wire. Alternatively, a linear variable differential transformer (LVDT) may be mounted to the polished rod 233*p* and a series of ferromagnetic targets may be disposed along the tower 234*t*.

The motor driver 215*m* may be in electrical communication with the stator of the motor 206*m* via a power cable. The power cable may include a pair of conductors for each phase of the electric motor 206*m*. The motor driver 215*m* may be variable speed including a rectifier and an inverter. The motor driver 215*m* may receive a three phase alternating current (AC) power signal from a three phase power source, such as a generator or transmission lines. The rectifier may convert the three phase AC power signal to a direct current (DC) power signal and the inverter may modulate the DC power signal to drive each phase of the motor stator based on signals from the laser rangefinder 215*t* and control signals from the PLC 215*p*.

The power converter 215*c* may include a rectifier, a transformer, and an inverter for converting electric power generated by the electric motor 206*m* on the downstroke to usable power for storage by the battery 215*b*. The battery 215*b* may then return the stored power to the motor driver 215*m* on the upstroke, thereby lessening the demand on the three phase power source.

Alternatively, the sucker rod position may be determined by the motor driver 215*m* having a voltmeter and/or ammeter in communication with each phase of the electric motor 206*m*. Should the motor be switched reluctance or brushless DC, at any given time, the motor driver 215*m* may drive only two of the stator phases and may use the voltmeter and/or ammeter to measure back electromotive force (EMF) in the idle phase. The motor driver 215*m* may then use the measured back EMF from the idle phase to determine the position of the polished rod 233*p*. Alternatively, a turns counter may be torsionally connected to the rotor of the electric motor 206*m* for measuring the polished rod position.

The torsional arrestor 234*a* may include one or more (four shown) wheel assemblies. Each wheel assembly may include a friction wheel, a shaft, one or more blocks, and one or more bearings. Each friction wheel may be biased into engagement with the polished rod 233*p* and supported for rotation relative to the blocks by the bearings. The blocks may be housed in and connected to the stuffing box 202*b*. The wheel assemblies may be oriented to allow longitudinal movement of the polished rod 233*p* relative to the stuffing box 202*b* and to prevent rotation of the polished rod relative to the stuffing box.

Alternatively, the torsional arrestor 234*a* may be a separate unit having its own housing connected to an upper or lower end of the stuffing box 202*b*, such as by a flanged connection. Alternatively, the torsional arrestor 234*a* may include a retractor operable by the PLC 215*p* such that the PLC may regularly briefly disengage the torsional arrestor 234*a* from the polished rod 233*p* to allow rotation the rod string 230*r* by a fraction of a turn. The fractional rotation of the polished rod 233*p* may prolong the life of the production tubing in case that the rod string 230*r* rubs against the production tubing during reciprocation thereof. In this alternative, an annular mirror may be used instead of the mirror 10*m* and the control system 215 may further include a turns counter so that the PLC 215*p* may monitor rotation of the polished rod 233*p* while the torsional arrestor is disengaged.

Figure 9:
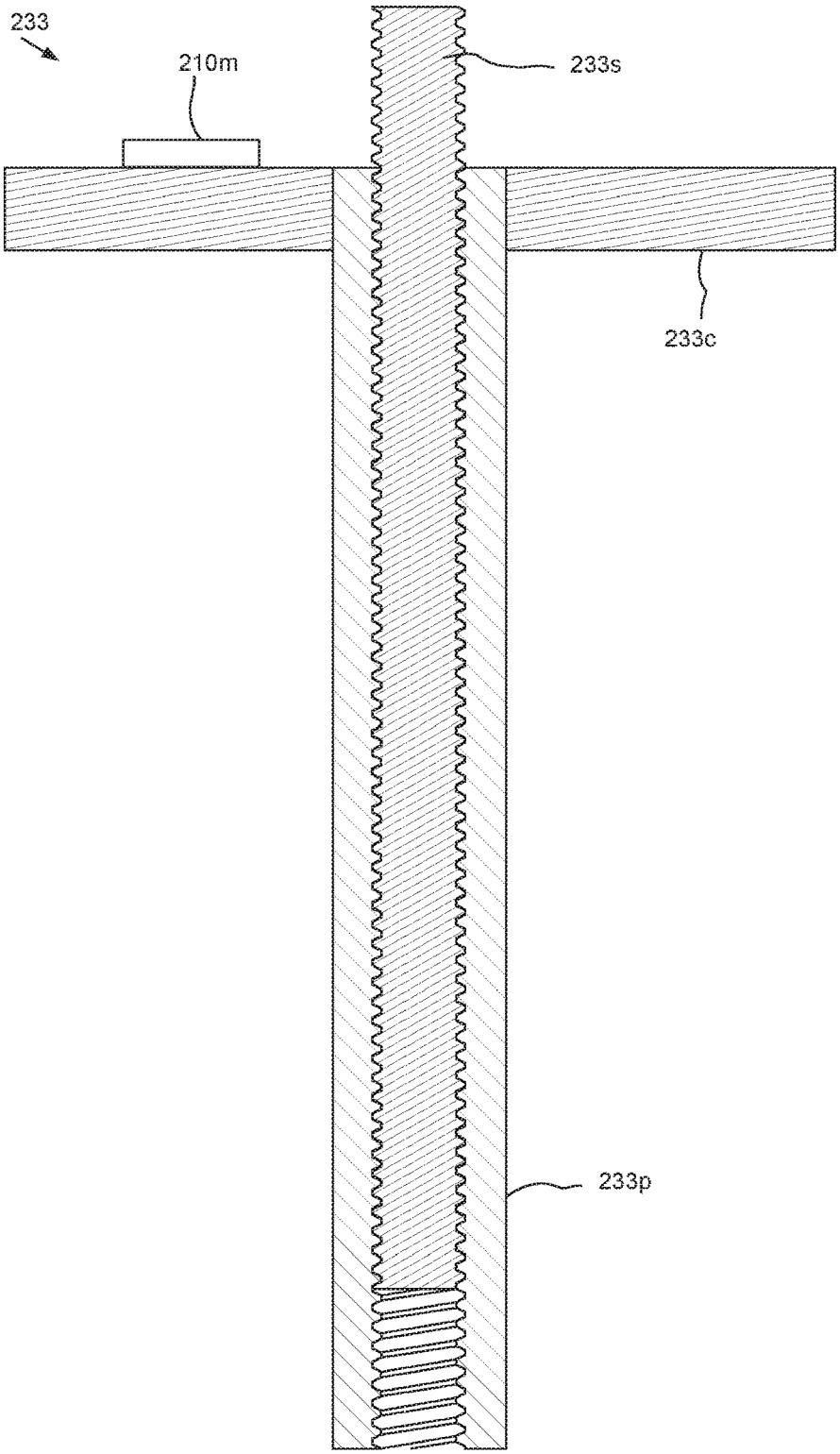
FIG. 9 illustrates a lead screw of the direct drive pumping unit.

FIG. 9 illustrates the lead screw 233. The lead screw 233 may include the screw shaft 2233*s*, the polished rod 233*p*, a clamp 233*c*, and the mirror 10*m*. The screw shaft 233*s* may extend from the thrust bearing 234*b* and into the polished rod 233*p* such that a bottom of the screw shaft may be aligned with the stuffing box 202*b*. The screw shaft 233*s* may have a trapezoidal thread formed along an outer surface thereof. The polished rod 233*p* may have an inner trapezoidal thread formed open to a top thereof and extending along most of a length thereof. The trapezoidal threads may be complementary and at least a portion thereof may remain mated during operation of the direct drive pumping unit 230*k*. A lower portion of the polished rod 233*p* may be solid and have an external thread formed at a bottom thereof for connection to the sucker rod string 204*s*. The clamp 233*c* may be fastened to an upper end of the polished rod 233*p*. The mirror 10*m* may be mounted on an upper surface of the clamp 233*c* and in the line of sight of the laser rangefinder 215*t*.

Alternatively, the threads may be square, round, or buttress instead of trapezoidal.

In operation, the electric motor 206*m* may be activated by the PLC 215*p* and operated by the motor driver 215*m* to rotate the screw shaft 233*s* in both clockwise and counterclockwise directions, thereby reciprocating the rod string 230*r* due to the polished rod 233*p* being torsionally restrained by the arrestor 234*a*. Reciprocation of the rod string 230*r* may drive the downhole pump, thereby lifting production fluid from the wellbore 202*w* to the wellhead 202*h*.

The PLC 215*p* may monitor power consumption by the motor driver 215*m* during the upstroke for detecting failure of the rod string 230*r*. Should the PLC 215*p* detect failure of the rod string 230*r*, the PLC 215*p* may shut down the electric motor 206*m* and report the failure to a home office via long distance telemetry (not shown). The PLC 215*p* may report failure of the rod string 230*r* to the home office so that a workover rig (not shown) may be dispatched to the well site to repair the rod string 230*r*.

Figure 10:
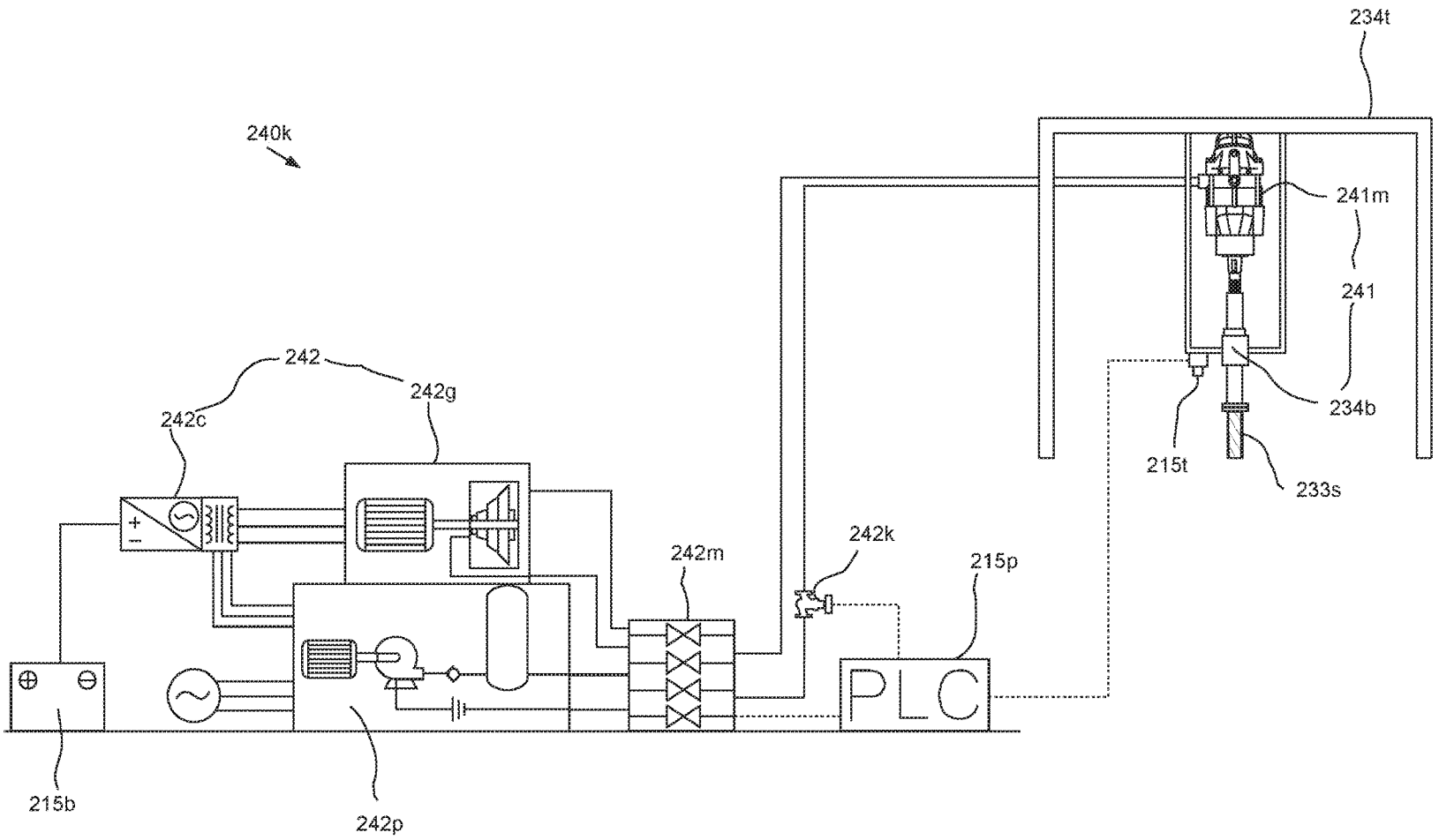
FIG. 10 illustrates an alternative direct drive pumping unit, according to another embodiment of the present disclosure.

FIG. 10 illustrates an alternative direct drive pumping unit 240*k*, according to another embodiment of the present disclosure. The alternative direct drive pumping unit 240*k* may be part of an artificial lift system further including the rod string (not shown, see 230*r* in FIG. 8) and the downhole pump (not shown). The direct drive pumping unit 240*k* may include a skid (not shown), a reciprocator 241, and a control system 242.

The reciprocator 241 may include the lead screw (only screw shaft 233*s* shown), the torsional arrestor 234*a* (not shown, see 234*a* in FIG. 8), the thrust bearing 234*b*, the tower 234*t*, and a hydraulic motor 241*m*. A stator of the hydraulic motor 241*m* may be mounted to the lower surface of the top of the tower 234*t*. A rotor of the hydraulic motor may be torsionally connected to the thrust shaft of the thrust bearing 234*b* by the slide joint.

The control system 242 may include the battery 215*b*, the PLC 215*p*, the laser rangefinder 215*t*, a power converter 242*c*, a turbine-generator set 242*g*, a variable choke valve 242*k*, a manifold 242*m*, and a hydraulic power unit (HPU) 242*p*. The HPU 242*p* may include an electric motor, a pump, a check valve, an accumulator, and a reservoir of hydraulic fluid. A pair of hydraulic conduits may connect an outlet of the manifold 242*m* and the hydraulic motor 241*m*. Another pair of hydraulic conduits may connect the HPU 242*p* and an inlet of the manifold 242*m*. Another pair of hydraulic conduits may connect the turbine-generator set 242*g* and the inlet of the manifold 242*m*. The electric motor of the HPU 242*p* may receive a three phase alternating current (AC) power signal from the three phase power source. The manifold 242*m* may include a pair of directional control valves or a plurality of actuated shutoff valves controlled by the PLC 215*p*, such as electrically pneumatically, or hydraulically. The variable choke valve 242*k* may be assembled as part of one of the motor conduits and operated, such as electrically pneumatically, or hydraulically, by the PLC 215*p* to control a speed of the hydraulic motor 241*m*.

The PLC 215*p* may operate the manifold 242*m* to place the HPU 242*p* in fluid communication with the hydraulic motor 241*m* for driving an upstroke of the reciprocator 241 and may operate the manifold to place the turbine-generator set 242*g* in fluid communication with the hydraulic motor for recovering energy from the reciprocator during a downstroke thereof. The hydraulic motor 242*m* may act as a pump on the downstroke, thereby supplying pressurized hydraulic fluid to the turbine-generator set 242*g*. The power converter 242*c* may include a rectifier/inverter and a transformer and for converting electric power generated by the turbine-generator set 242*g* on the downstroke to usable power for storage by the battery 215*b*. The battery 215*b* may then return the stored power to the HPU 242*p* on the upstroke, thereby lessening the demand on the three phase power source.

Alternatively, an application-specific integrated circuit (ASIC) or field-programmable gate array (FPGA) may be used as the controller in the control system 242 instead of the PLC 215*p*. Alternatively, the laser rangefinder 215*t* may be mounted to the tower 234*t* instead of the bracket. Alternatively, any of the alternative polished rod position sensors discussed above may be adapted for use with the alternative direct drive pumping system 240*k* instead of the laser rangefinder 215*t*.

In operation, the hydraulic motor 241*m* may be activated by the PLC 215*p* via the manifold 241*m* to rotate the screw shaft 233*s* in both clockwise and counterclockwise directions, thereby reciprocating the rod string 230*r* due to the polished rod 233*p* being torsionally restrained by the arrestor 234*a*. Reciprocation of the rod string 230*r* may drive the downhole pump, thereby lifting production fluid from the wellbore 202*w* to the wellhead 202*h*.

Figure 11:
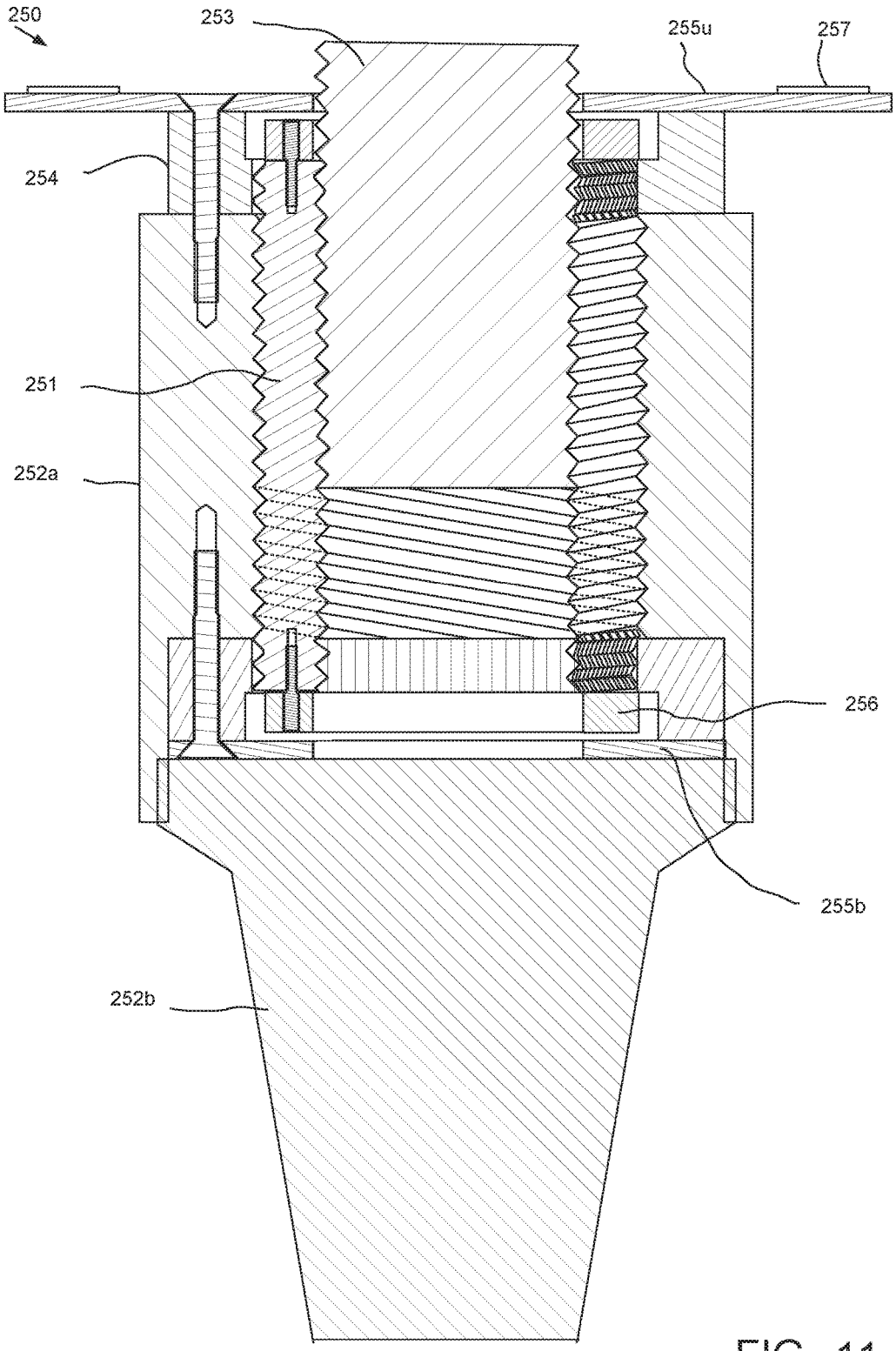
FIG. 11 illustrates a roller screw for use with either direct drive pumping unit instead of the lead screw, according to another embodiment of the present disclosure.

FIG. 11 illustrates a roller screw 250 for use with either direct drive pumping unit 230*k*, 240*k* instead of the lead screw 233, according to another embodiment of the present disclosure. The roller screw 250 may include a plurality (one shown in section and one shown with back lines) of planetary threaded rollers 251, a polished rod 252*a,b*, a screw shaft 253, a pair of ring gears 254, an upper retainer 255*u*, a lower retainer 255*b*, a pair of yokes 256, and an annular mirror 257. To accommodate assembly of the roller screw 250, the polished rod 252*a,b* may include an upper roller nut section 252*a* and a lower threaded pin section 252*b*. The polished rod sections 252*a,b* may be connected, such as by mating threaded ends.

The screw shaft 253 may have a thread formed along an outer surface thereof and the roller nut section 252*a* may have a thread formed along an inner surface thereof. The threads may be configured to form a helical raceway therebetween and the threaded rollers 251 may be disposed in the raceway and may mate with the threads. Each yoke 256 may be transversely connected to a respective end of the threaded rollers 251, such as by a fastener. The thread of each roller 251 may be longitudinally cut adjacent to ends thereof for forming pinions. The pinions may mesh with the respective ring gears 254. The ring gears 254 and retainers 255*u,b* may be mounted to the roller nut section 252*a*, such as by threaded fasteners. The upper retainer 255*u* may be enlarged to also serve the function of the rod clamp 233*c*.

Figure 12:
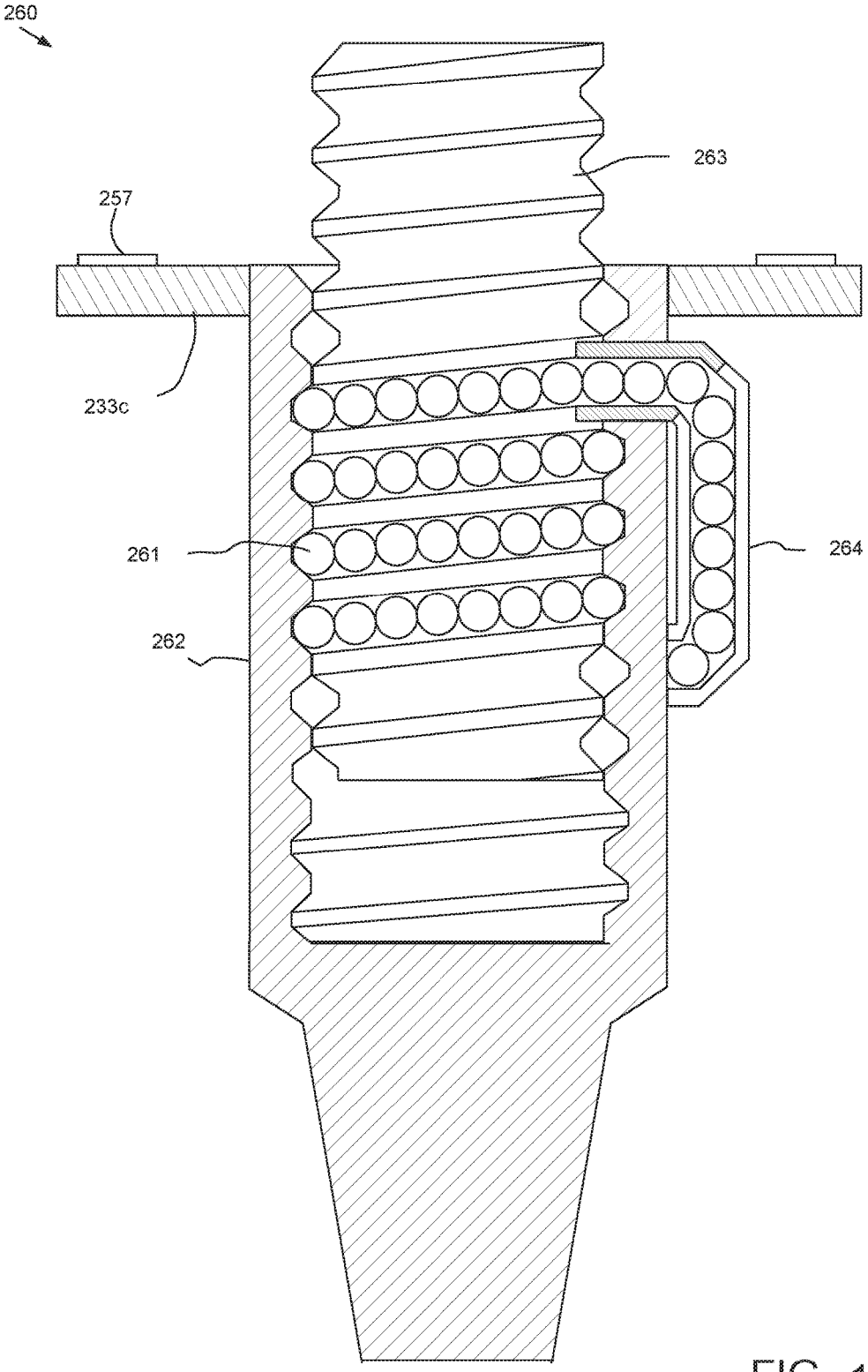
FIG. 12 illustrates a ball screw for use with either direct drive pumping unit instead of the lead screw, according to another embodiment of the present disclosure.

FIG. 12 illustrates a ball screw 260 for use with either direct drive pumping unit 230*k*, 240*k* instead of the lead screw 233, according to another embodiment of the present disclosure. The ball screw 260 may include a plurality of balls 261, a polished rod 262, a screw shaft 263, a return tube 264, the rod clamp 233*c*, and the annular mirror 257. The screw shaft 263 may extend into the polished rod 262. The screw shaft 263 may have a trapezoidal thread formed along an outer surface thereof and the polished rod 262 may have a trapezoidal thread formed along an inner surface thereof. The trapezoidal threads may be configured to form a helical raceway therebetween and the balls 261 may be disposed in the raceway. A pair (only one shown) of ball cavities may be formed through a wall of the polished rod 262 and the return tube 264 may have ends disposed in the cavities for recirculation of the balls 261 through the raceway.

Alternatively, the threads may be square, round, or buttress instead of trapezoidal. Alternatively, the ball screw 260 may include an internal button style return instead of the return tube 264. Alternatively, the ball screw 260 may include an end cap style return instead of the return tube 264. The end cap return may include a return end cap, a compliant end cap, and a ball passage formed longitudinally through a wall of the ball nut.

Figure 13:
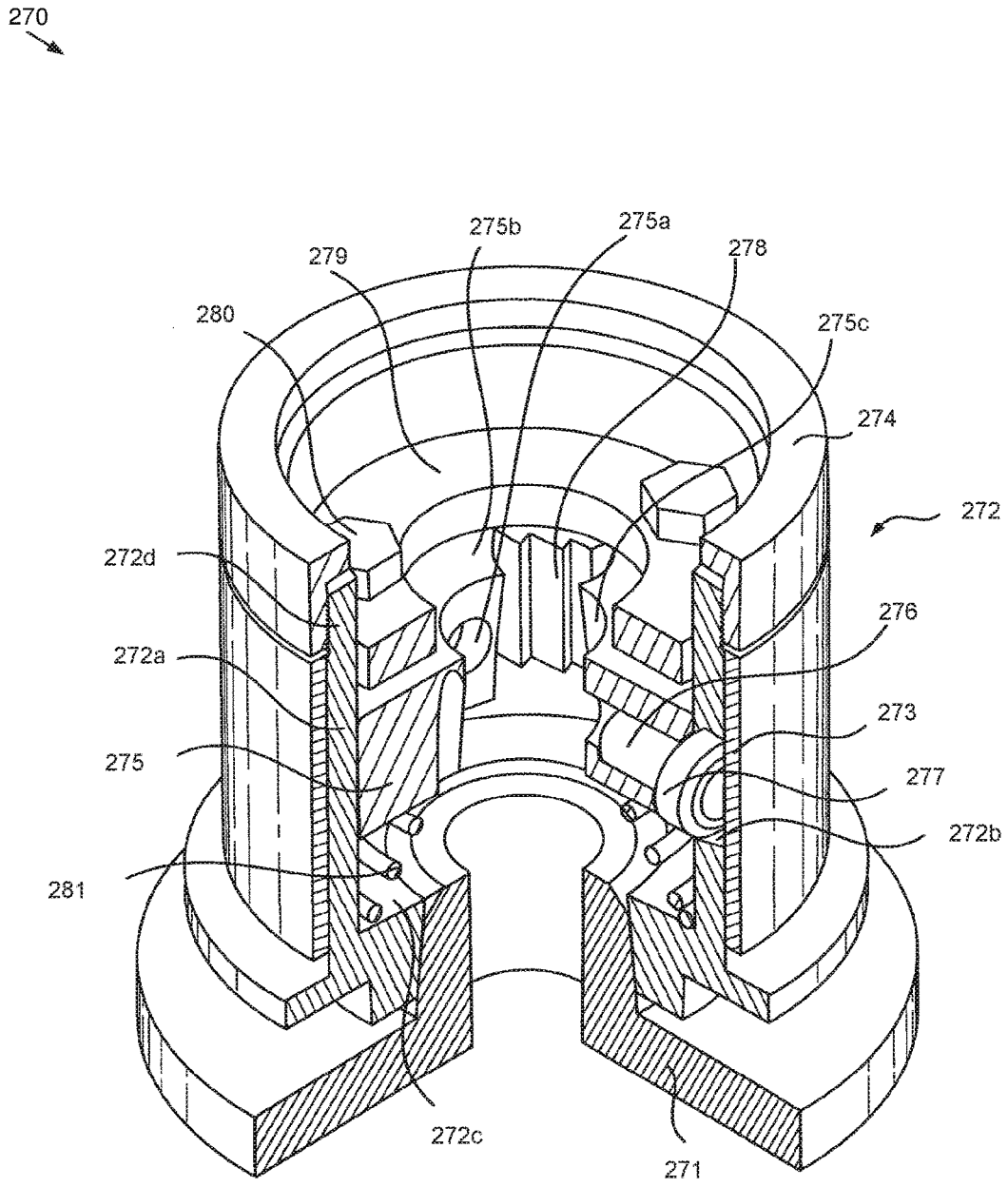
FIG. 13 illustrates a rod rotator for use with either direct drive pumping unit instead of the torsional arrestor, according to another embodiment of the present disclosure.

FIG. 13 illustrates a rod rotator 270 for use with either direct drive pumping unit 230*k*, 240*k* instead of the torsional arrestor 234*a*, according to another embodiment of the present disclosure. The rod rotator 270 may include a stator 271 and a traveler 272. The stator 271 and a traveler 272 may be in a docked position through mutually docking surfaces made in the shape of self-locking (or self-braking) cones. The traveler 272 may include a body 272*a* that has one or more, such as a pair, of spiral slots 272*b*, a bottom 272*c*, and thread 272*d* on the upper end. A cover 273 may be placed on the body 272*a* from outside, and the upper thread may have a cap screw 274. The inner hollow part of the body 272*a* may include a cam 275. The cam 275 may have one or more, such as two, horizontal holes 275*a* where shafts 276 with rollers 277 are installed. Cotters 278 with teeth to grip the polished rod 233*p* may be located from the upper face plane 275*b* of the cam 275 exiting through its central hole 275*c*. The cotters 278 may be placed in seats in the cam 275 and clamped between polished rod 233*p* and the cam 275 with a round plate 279 and bolts 280.

Inside the body 272*a*, there may be a spring 281 between the cam 275 and the bottom 272*c*. The ends of the spring 281 may butt into the cam 275 and bottom 272*c* and the spring may contract and expand when the cam 275 moves up and down. The stator 271 may have a flange for attaching with bolts or stud bolts to the stuffing box 202*b*.

In operation, as the polished rod 233*p* moves downward, the traveler 272 moves to the stator 271 installed on the stuffing box 202*b*. At a predetermined distance, the traveler 272 and stator 271 dock using their docking surfaces. From this moment on, both parts 271 and 272 remain fixed with respect to each other. The movement down continues only by the cam 275 under the weight of the rod string 230*r* connected with the polished rod 233*p*. The weight of rod string 230*r* forces the cam 275 to move down using the rollers 277 on spiral slots 272*b* rotating the polished rod 233*p* along with the sucker rod string 204*s* until the completion of the downstroke. In the process of the downward movement of the cam 275, the spring 281 is pressed to the bottom 272*c*. The rollers 277 having reached the lower position in the spiral slots 272*b* complete the rotation of the rod string 230*r* with respect to the production string 202*p*. The rotation angle of the rod string 230*r* may be determined by the angle of gradient of the spiral slots 272*b* and may be a fraction of a turn.

During the upstroke, the traveler 272 may undock from the stator 271 and the compressed spring 281 may begin to expand pushing the free end of the traveler down and at the same time the body 272*a* both rotates and moves down with respect to the inactive cam 275. The spiral slots 272*b* may move down on the rollers 277 until the rollers are above the spiral slots 272*b*. As the upstroke continues, the rod rotator 270 stays static waiting for the completion thereof.

Figure 14A:
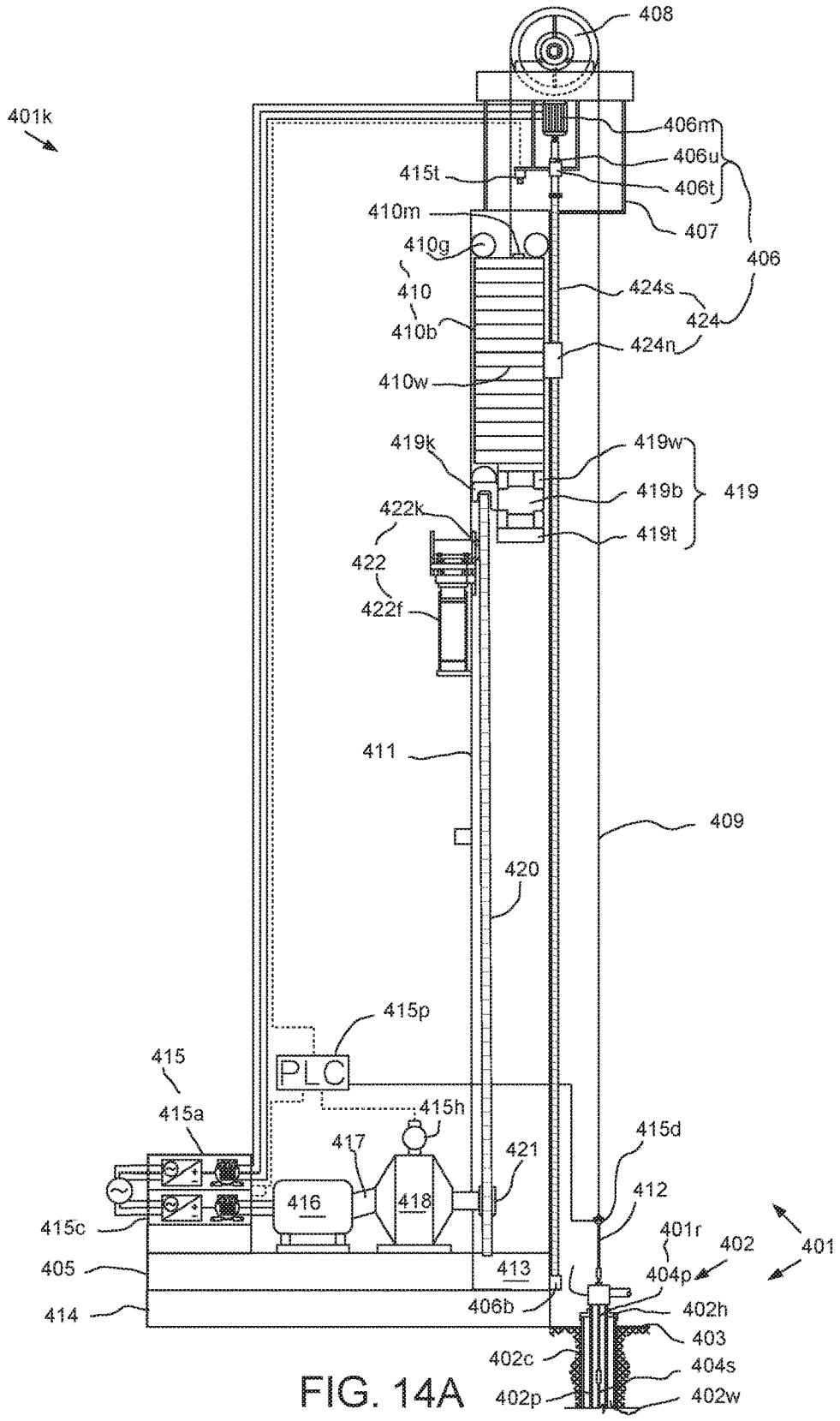
FIGS. 14A and 14B illustrate a long stroke pumping unit having a dynamic counterbalance system, according to one embodiment of the present disclosure.
Figure 14B:
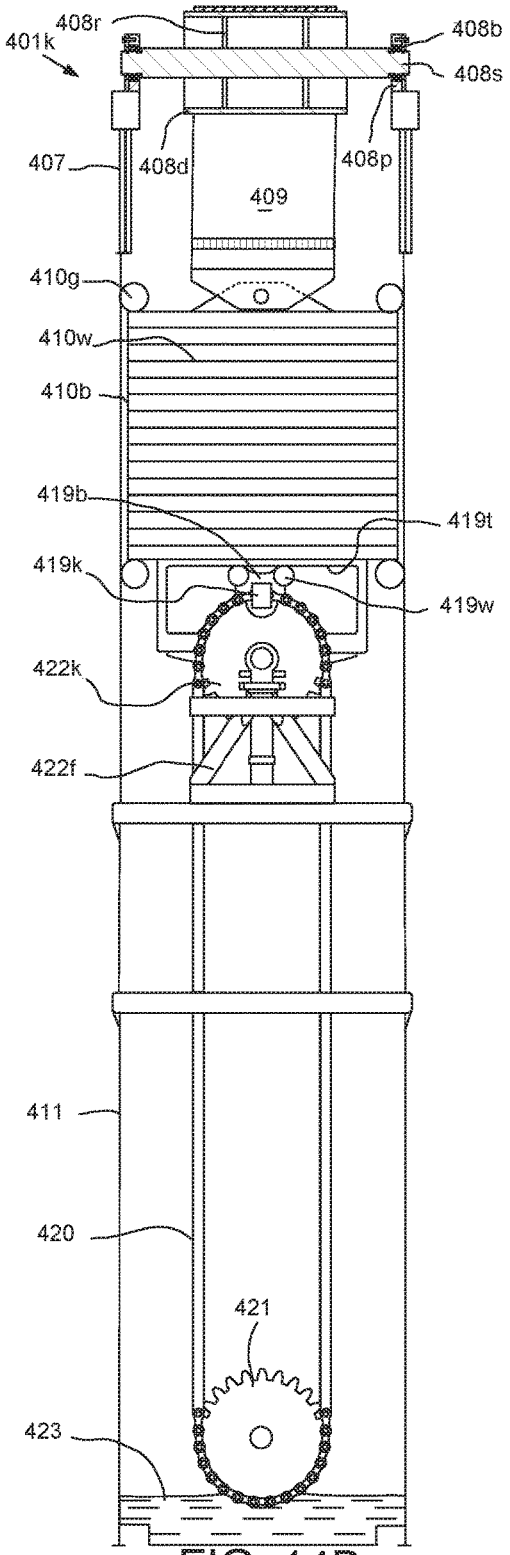

FIGS. 14A and 14B illustrate a long stroke pumping unit having a dynamic counterbalance system 406, according to one embodiment of the present disclosure. The long stroke pumping unit 401*k* may be part of an artificial lift system 401 further including a rod string 401*r* and a downhole pump (not shown). The artificial lift system 401 may be operable to pump production fluid (not shown) from a hydrocarbon bearing formation (not shown) intersected by a well 402. The well 402 may include a wellhead 402*h* located adjacent to a surface 403 of the earth and a wellbore 402*w* extending from the wellhead. The wellbore 402*w* may extend from the surface 403 through a non-productive formation and through the hydrocarbon-bearing formation (aka reservoir).

A casing string 402*c* may extend from the wellhead 402*h* into the wellbore 402*w* and be sealed therein with cement (not shown). A production string 402*p* may extend from the wellhead 402*h* and into the wellbore 402*w*. The production string 402*p* may include a string of production tubing and the downhole pump connected to a bottom of the production tubing. The production tubing may be hung from the wellhead 402*h*.

The downhole pump may include a tubular barrel with a standing valve located at the bottom that allows production fluid to enter from the wellbore 402*w*, but does not allow the fluid to leave. Inside the pump barrel may be a close-fitting hollow plunger with a traveling valve located at the top. The traveling valve may allow fluid to move from below the plunger to the production tubing above and may not allow fluid to return from the tubing to the pump barrel below the plunger. The plunger may be connected to a bottom of the rod string 401*r* for reciprocation thereby. During the upstroke of the plunger, the traveling valve may be closed and any fluid above the plunger in the production tubing may be lifted towards the surface 403. Meanwhile, the standing valve may open and allow fluid to enter the pump barrel from the wellbore 402*w*. During the downstroke of the plunger, the traveling valve may be open and the standing valve may be closed to transfer the fluid from the pump barrel to the plunger.

The rod string 401*r* may extend from the long stroke pumping unit 401*k*, through the wellhead 402*h*, and into the wellbore 402*w*. The rod string 401*r* may include a jointed or continuous sucker rod string 404*s* and a polished rod 404*p*. The polished rod 404*p* may be connected to an upper end of the sucker rod string 404*s* and the pump plunger may be connected to a lower end of the sucker rod string, such as by threaded couplings.

A production tree (not shown) may be connected to an upper end of the wellhead 402*h* and a stuffing box 402*b* may be connected to an upper end of the production tree, such as by flanged connections. The polished rod 404*p* may extend through the stuffing box 402*b*. The stuffing box 402*b* may have a seal assembly (not shown) for sealing against an outer surface of the polished rod 404*p* while accommodating reciprocation of the rod string 401*r* relative to the stuffing box.

The long stroke pumping unit 401*k* may include a skid 405, the dynamic counterbalance system 406, one or more ladders and platforms (not shown), a standing strut (not shown), a crown 407, a drum assembly 408, a load belt 409, one or more wind guards (not shown), a counterweight assembly 410, a tower 411, a hanger bar 412, a tower base 413, a foundation 414, a control system 415, a prime mover, such as a chain motor 416, a rotary linkage 417, a reducer 418, a carriage 419, a chain 420, a drive sprocket 421, and a chain idler 422. The control system 415 may include a programmable logic controller (PLC) 415*p*, a chain motor driver 415*c*, a counterweight position sensor, such as a laser rangefinder 415*t*, a load cell 415*d*, a tachometer 415*h*, and an adjustment motor driver 415*a*.

Alternatively, an application-specific integrated circuit (ASIC) or field-programmable gate array (FPGA) may be used as the controller in the control system 415 instead of the PLC 415*p*. Alternatively, the PLC 415*p* and/or the motor drivers 415*a,c* may be combined into one physical control unit.

The foundation 414 may support the pumping unit 401*k* from the surface 403 and the skid 405 and tower base 413 may rest atop the foundation. The PLC 415*p* may be mounted to the skid 405 and/or the tower 411. Lubricant, such as refined and/or synthetic oil 423, may be disposed in the tower base 413 such that the chain 420 is bathed therein as the chain orbits around the chain idler 422 and the drive sprocket 421.

The chain motor 416 may include a stator disposed in a housing mounted to the skid 405 and a rotor disposed in the stator for being torsionally driven thereby. The chain motor 416 may be electric and have one or more, such as three, phases. The chain motor 416 may be an induction motor, a switched reluctance motor, or a permanent magnet motor, such as a brushless direct current motor.

The chain motor driver 415*c* may be mounted to the skid 405 and be in electrical communication with the stator of the chain motor 416 via a power cable. The power cable may include a pair of conductors for each phase of the chain motor 416. The chain motor driver 415*c* may be variable speed including a rectifier and an inverter. The chain motor driver 415*c* may receive a three phase alternating current (AC) power signal from a three phase power source, such as a generator or transmission lines. The rectifier may convert the three phase AC power signal to a direct current (DC) power signal and the inverter may modulate the DC power signal to drive each phase of the motor stator based on speed instructions from the PLC 415*p*.

Alternatively, the chain motor 416 may be a hydraulic motor and the chain motor driver may be a hydraulic power unit. Alternatively, the prime mover may be an internal combustion engine fueled by natural gas available at the well site.

The rotary linkage 417 may torsionally connect a rotor of the chain motor 416 to an input shaft of the reducer 418 and may include a sheave connected to the rotor, a sheave connected to the input shaft, and a V-belt connecting the sheaves. The reducer 418 may be a gearbox including the input shaft, an input gear connected to the input shaft, an output gear meshed with the input gear, an output shaft connected to the output gear, and a gear case mounted to the skid 405. The output gear may have an outer diameter substantially greater than an outer diameter of the input gear to achieve reduction of angular speed of the chain motor 416 and amplification of torque thereof. The drive sprocket 421 may be torsionally connected to the output shaft of the reducer 418. The tachometer 415*h* may be mounted on the reducer 418 to monitor an angular speed of the output shaft and may report the angular speed to the PLC 415*p* via a data link.

The chain 420 may be meshed with the drive sprocket 421 and may extend to the idler 422. The idler 422 may include an idler sprocket 422*k* meshed with the chain 420 and an adjustable frame 422*f* mounting the idler sprocket to the tower 411 while allowing for rotation of the idler sprocket relative thereto. The adjustable frame 422*f* may vary a height of the idler sprocket 422*k* relative to the drive sprocket 421 for tensioning the chain 420.

The carriage 419 may longitudinally connect the counterweight assembly 410 to the chain 420 while allowing relative transverse movement of the chain relative to the counterweight assembly. The carriage 419 may include a block base 419*b*, one or more (four shown) wheels 419*w*, a track 419*t*, and a swivel knuckle 419*k*. The track 419*t* may be connected to a bottom of the counterweight assembly 410, such as by fastening. The wheels 419*w* may be engaged with upper and lower rails of the track 419*t*, thereby longitudinally connecting the block base 419*b* to the track while allowing transverse movement therebetween. The swivel knuckle 419*k* may include a follower portion assembled as part of the chain 420 using fasteners to connect the follower portion to adjacent links of the chain. The swivel knuckle 419*k* may have a shaft portion extending from the follower portion and received by a socket of the block base 419*b* and connected thereto by bearings (not shown) such that swivel knuckle may rotate relative to the block base.

The counterweight assembly 410 may be disposed in the tower 411 and longitudinally movable relative thereto. The counterweight assembly 410 may include a box 410*b*, one or more counterweights 410*w* disposed in the box, and guide wheels 410*g*. Guide wheels 410*g* may be connected at each corner of the box 410*b* for engagement with respective guide rails 429 (FIG. 20A) of the tower 411, thereby torsionally and transversely connecting the box to the tower. The box 410*b* may be loaded with counterweights 410*w* until a total balancing weight of the counterweight assembly 410 corresponds to the weight of the rod string 401*r* and/or the weight of the column of production fluid. The counterweight assembly 410 may further include a mirror 410*m* mounted to a top of the box 410*b* and in a line of sight of the laser rangefinder 415*t*.

The crown 407 may be a frame mounted atop the tower 411. The drum assembly 408 may include a drum 408*d*, a shaft 408*s*, one or more ribs 408*r* connecting the drum to the shaft, one or more pillow blocks 408*p* mounted to the crown 407, and one or more bearings 408*b* for supporting the shaft from the pillow blocks while accommodating rotation of the shaft relative to the pillow blocks.

The load belt 409 may have a first end longitudinally connected to a top of the counterweight box 410*b*, such as by a hinge, and a second end longitudinally connected to the hanger bar 412, such as by wire rope. The load belt 409 may extend from the counterweight assembly 410 upward to the drum assembly 408, over an outer surface of the drum, and downward to the hanger bar 412. The hanger bar 412 may be connected to the polished rod 404*p*, such as by a rod clamp, and the load cell 415*d* may be disposed between the rod clamp and the hanger bar. The load cell 415*d* may measure force exerted on the rod string 401*r* by the long stroke pumping unit 401*k* and may report the measurement to the PLC 415*p* via a data link.

The laser rangefinder 415*t* may be mounted to a guide frame of a tensioner 406*t* of the dynamic counterbalance system 406 and may be aimed at the mirror 410*m*. The laser rangefinder 415*t* may be in power and data communication with the PLC 415*p* via a cable. The PLC 415*p* may relay the position measurement of the counterweight assembly 410 to the motor drivers 415*a,c* via a data link. The PLC 415*p* may also utilize measurements from the laser rangefinder 415*t* to determine velocity of the counterweight assembly 410.

Alternatively, the counterweight position sensor may be an ultrasonic rangefinder instead of the laser rangefinder 415*t*. The ultrasonic rangefinder may include a series of units spaced along the tower 411 at increments within the operating range thereof. Each unit may include an ultrasonic transceiver (or separate transmitter and receiver pair) and may detect proximity of the counterweight box 410*b* when in the operating range. Alternatively, the counterweight position sensor may be a string potentiometer instead of the laser rangefinder 415*t*. The potentiometer may include a wire connected to the counterweight box 410*b*, a spool having the wire coiled thereon and connected to the crown 407 or tower base 413, and a rotational sensor mounted to the spool and a torsion spring for maintaining tension in the wire. Alternatively, a linear variable differential transformer (LVDT) may be mounted to the counterweight box 410*b* and a series of ferromagnetic targets may be disposed along the tower 411.

The dynamic counterbalance system 406 may include an adjustment motor 406*m*, a tensioner 406*t*, one or more thrust bearings 406*u,b*, and a linear actuator, such as a ball screw 424. The adjustment motor 406*m* may be electric and have one or more, such as three, phases. The adjustment motor 406*m* may be a switched reluctance motor or a permanent magnet motor, such as a brushless direct current motor. The adjustment motor 406*m* may include a stator mounted to the crown 407 and a rotor disposed in the stator for being torsionally driven thereby.

The adjustment motor driver 415*a* may be mounted to the skid 405 and be in electrical communication with the stator of the adjustment motor 406*m* via a power cable. The power cable may include a pair of conductors for each phase of the adjustment motor 406*m*. The adjustment motor driver 415*a* may be variable torque including a rectifier and an inverter. The adjustment motor driver 415*a* may receive a three phase alternating current (AC) power signal from the three phase power source. The rectifier may convert the three phase AC power signal to a direct current (DC) power signal and the inverter may modulate the DC power signal to drive each phase of the motor stator based on based on torque instructions from the PLC 415*p*.

Alternatively, the adjustment motor 406*m* may be mounted in the tower base 413 instead of to the crown 407. Alternatively, the counterweight position may be determined by the adjustment motor driver 415*a* having a voltmeter and/or ammeter in communication with each phase. At any given time, the adjustment motor driver 415*a* may drive only two of the stator phases and may use the voltmeter and/or ammeter to measure back electromotive force (EMF) in the idle phase. The adjustment motor driver 415*a* may then use the measured back EMF from the idle phase to determine the position of the counterweight assembly 410.

The upper thrust bearing 406*u* may include a housing, a drive shaft, a thrust runner, and a thrust carrier. The drive shaft may be torsionally connected to the rotor of the adjustment motor 406*m* by a slide joint, such as splines formed at adjacent ends of the rotor and drive shaft. The drive shaft may also be longitudinally and torsionally connected to an upper end of a screw shaft 424*s* of the ball screw 424, such as by a flanged connection. The thrust housing may be longitudinally and torsionally connected to the tensioner 406*t* and have lubricant, such as refined and/or synthetic oil, disposed therein. The thrust runner may be mounted on the drive shaft and the thrust carrier may be mounted in the thrust housing. The thrust carrier may have two or more load pads formed in a face thereof adjacent the thrust runner for supporting weight of the screw shaft 424*s* and tension exerted on the screw shaft by the tensioner 406*t*.

The tensioner 406*t* may include a linear actuator (not shown), such as a piston and cylinder assembly, a slider, the guide frame, and a hydraulic power unit (not shown). The thrust housing may be mounted to the slider and the guide frame may be mounted to the crown 407. The slider may be torsionally connected to but free to move along the guide frame. An upper end of the piston and cylinder assembly may be pivotally connected to the crown and a lower end of the piston and cylinder assembly may be pivotally connected to the slider. The hydraulic power unit may be in fluid communication with the piston and cylinder assembly and be in data communication with the PLC 415*p* via a data link.

The screw shaft 424*s* may extend between the crown 407 and the tower base 413. The lower thrust bearing 406*b* may include a housing, a thrust shaft, a thrust runner, and a thrust carrier. The thrust shaft may be longitudinally and torsionally connected to a lower end of the screw shaft 424*s*, such as by a flanged connection (not shown) and the lower thrust housing may be mounted to the tower base 413. The lower thrust housing may have lubricant, such as refined and/or synthetic oil, disposed therein. The lower thrust runner may be mounted on the thrust shaft and the lower thrust carrier may be mounted in the lower thrust housing. The lower thrust carrier may have two or more load pads formed in a face thereof adjacent the thrust runner for supporting the tension exerted on the screw shaft 424*s* by the tensioner 406*t*.

Figure 15:
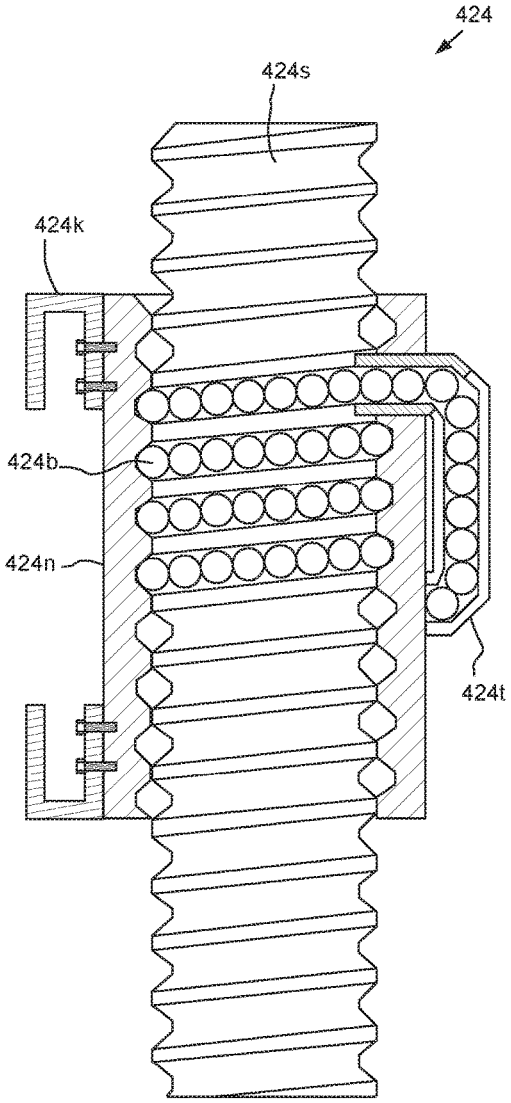
FIG. 15 illustrates a ball screw of the long stroke pumping unit.

FIG. 15 illustrates the ball screw 424. The ball screw 424 may include a plurality of balls 424*b*, one or more (pair shown) brackets 424*k*, a ball nut 424*n*, the screw shaft 424*s*, and a return tube 424*t*. The screw shaft 424*s* may extend through the ball nut 424*n*. The ball nut 424*n* may be mounted to a side of the counterweight box 410*b* by the brackets 424*k*. Each bracket 424*k* may be fastened to an outer surface of the ball nut 424*n*. The ball nut 424*n* may be mounted to one of the sides of the counterweight box 410*b* facing the guide rails 429 of the tower 411 and the respective guide rail may be split to accommodate reciprocation of the ball nut along the tower or the ball nut may be mounted to one of the sides of the counterweight box not facing one of the guide rails. The screw shaft 424*s* may have a trapezoidal thread formed along an outer surface thereof and the ball nut 424*n* may have a trapezoidal thread formed along an inner surface thereof. The trapezoidal threads may be configured to form a helical raceway therebetween and the balls 424*b* may be disposed in the raceway. A pair (only one shown) of ball cavities may be formed through a wall of the ball nut 424*n* and the return tube 424*t* may have ends disposed in the cavities for recirculation of the balls 424*b* through the raceway.

Alternatively, the threads may be square, round, or buttress instead of trapezoidal. Alternatively, the ball screw 424 may include an internal button style return instead of the return tube 424*t*. Alternatively, the ball screw 424 may include an end cap style return instead of the return tube 424*t*. The end cap return may include a return end cap, a compliant end cap, and a ball passage formed longitudinally through a wall of the ball nut.

Figure 16:
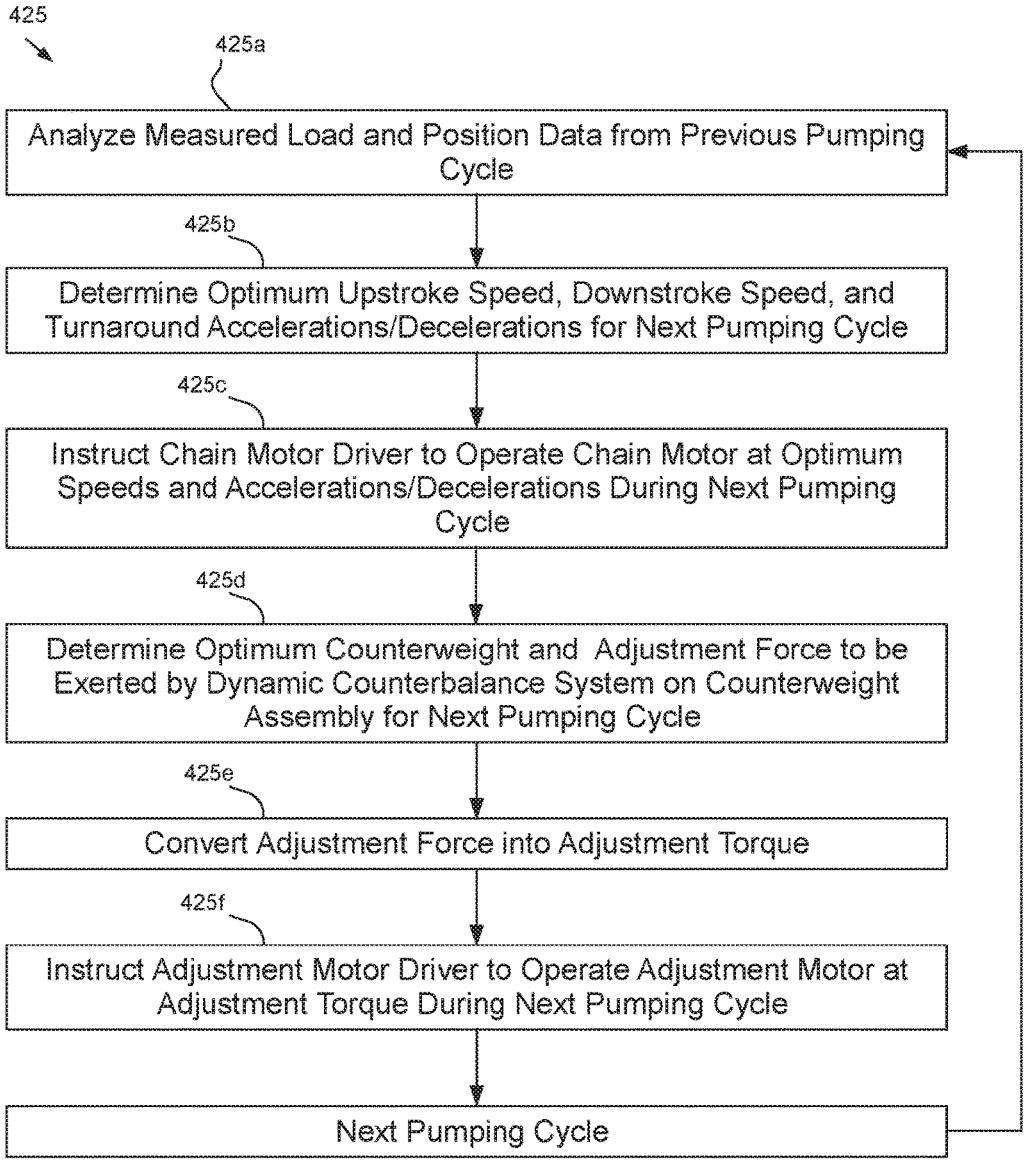
FIG. 16 illustrates control of the long stroke pumping unit.

FIG. 16 illustrates control of the long stroke pumping unit 401*k*. In operation, the chain motor 406 is activated by the PLC 415*p* and operated by the chain motor driver 415*c* to torsionally drive the drive sprocket 421 via the linkage 417 and reducer 418. Rotation of the drive sprocket 421 drives the chain 420 in an orbital loop around the drive sprocket and the idler sprocket 422*k*. The swivel knuckle 419*k* follows the chain 420 and resulting movement of the block base 419*b* along the track 419*t* translates the orbital motion of the chain into a longitudinal driving force for the counterweight assembly 410, thereby reciprocating the counterweight assembly along the tower 411. Reciprocation of the counterweight assembly 410 counter-reciprocates the rod string 401*r* via the load belt 409 connection to both members. During reciprocation of the counterweight assembly 410, the tensioner 406*t* is operated by the PLC 415*p* via the hydraulic power unit to maintain sufficient tension in the screw shaft 424*s* for rotational stability thereof.

During operation of the long stroke pumping unit 401*k*, the PLC 415*p* may coordinate operation of the adjustment motor 406*m* with the chain motor 416 by being programmed to perform an operation 425. The operation 425 may include a first act 425*a* of analyzing load data (from load cell 415*d*) and position data (from rangefinder 415*t*) for a previous pumping cycle. The PLC 415*p* may use this analysis to perform a second act 425*b* of determining an optimum upstroke speed, downstroke speed, and turnaround accelerations and decelerations for a next pumping cycle. The PLC 415*p* may then perform a third act 425*c* of instructing the chain motor driver 415*c* to operate the chain motor 416 at the optimum speeds, accelerations, and decelerations during the next pumping cycle.

Before, during, or after the second 425*b* and third 425*c* acts, the PLC 415*p* may use the analysis to perform a fourth act 425*d* of determining an optimum counterweight for the next pumping cycle. The PLC 415*p* may then subtract the known total balancing weight of the counterweight assembly 410 from the optimum counterweight to determine an adjustment force to be exerted by the dynamic counterbalance system 406 on the counterweight assembly 410 during the next pumping cycle. The adjustment force may be a fraction of the total balancing weight, such as less than or equal to one-half, one-third, one-fourth, one-fifth, or one-tenth thereof. The PLC 415*p* may then use known parameters (or a formula) for the ball screw 424 to perform a fifth act 425*e* of converting the adjustment force into an adjustment torque for the adjustment motor 406*m*. The PLC 415*p* may then perform a sixth act 425*f* of instructing the adjustment motor driver 415*a* to operate the adjustment motor 406*m* at the adjustment torque during the next pumping cycle.

During the next pumping cycle, if the optimum counterweight is greater than the total balancing weight, then the adjustment motor driver 415*a* will drive the adjustment motor 415*a* to exert a downward force on the counterweight assembly 410 via the ball screw 424. As such, the adjustment motor 406*m* will act as a drag by resisting rotation of the screw shaft 424*s*. Using position data from the rangefinder 415*t* and velocity data from the PLC 415*p*, the adjustment motor driver 415*a* may determine when to exert the adjustment torque during the upstroke and when to alternate to counter adjustment torque for the downstroke so that the adjustment force remains downward during both strokes.

Conversely, during the next pumping cycle, if the optimum counterweight is less than the total balancing weight, then the adjustment motor driver 415*a* will drive the adjustment motor 415*a* to exert an upward force on the counterweight assembly 410 via the ball screw 424. As such, the adjustment motor 406*m* will act as a booster by assisting rotation of the screw shaft 424*s*. Using position data from the rangefinder 415*t* and velocity data from the PLC 415*p*, the adjustment motor driver 415*a* may determine when to exert the adjustment torque during the upstroke and when to alternate to counter adjustment torque for the downstroke so that the adjustment force remains upward during both strokes.

If the optimum counterweight is equal to the total balancing weight, then the PLC 415*p* may instruct the adjustment motor driver 415*a* to idle the adjustment motor 406*m* during the next pumping cycle. The PLC 415*p* may also instruct the adjustment motor driver 415*a* to idle the adjustment motor 406*m* during the first pumping cycle.

Should the PLC 415*p* detect failure of the rod string 401*r* by monitoring the rangefinder 415*t* and/or the load cell 415*d*, the PLC may instruct the motor drivers 415*a,c* to operate the respective motors 406*m*, 416 to control the descent of the counterweight assembly 410 until the counterweight assembly reaches the tower base 413 while operating the tensioner 406*t* to increase tension in the screw shaft 416*s* to accommodate the controlled descent. The PLC 415*p* may then shut down the motors 406*m*, 416. The PLC 415*p* may be in data communication with a home office (not shown) via long distance telemetry (not shown). The PLC 415*p* may report failure of the rod string 401*r* to the home office so that a workover rig (not shown) may be dispatched to the well site to repair the rod string 401*r*.

Alternatively, the control system 415 may further include a power converter and a battery. The power converter may include a rectifier, a transformer, and an inverter for converting electric power generated by the chain motor 416 on the downstroke to usable power for storage by the battery. The battery may then return the stored power to the motor driver 415*m* on the upstroke, thereby lessening the demand on the three phase power source.

Figure 17:
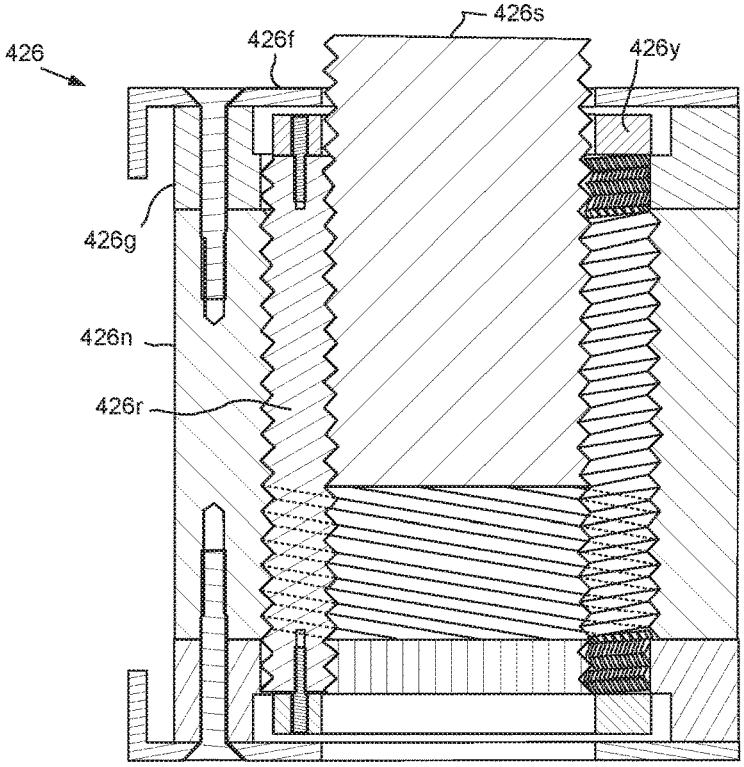
FIG. 17 illustrates a roller screw for use with the long stroke pumping unit instead of the ball screw, according to another embodiment of the present disclosure.

FIG. 17 illustrates a roller screw 426 for use with the long stroke pumping unit instead of the ball screw 424, according to another embodiment of the present disclosure. The roller screw 426 may include a plurality (one shown in section and one shown with back lines) of planetary threaded rollers 426*r*, a roller nut 426*n*, a screw shaft 426*s*, a pair of ring gears 426*g*, a pair of retainers 426*f*, and a pair of yokes 426*y*. Even though not shown extending entirely through the roller nut 426*n* for illustrative purpose, the screw shaft 426*s* may extend between the crown 407 and the tower base 413 and through the roller nut.

The screw shaft 426*s* may have a thread formed along an outer surface thereof and the roller nut 426*n* may have a thread formed along an inner surface thereof. The threads may be configured to form a helical raceway therebetween and the threaded rollers 426*r* may be disposed in the raceway and may mate with the threads. Each yoke 426*y* may be transversely connected to a respective end of the threaded rollers 426*r*, such as by a fastener. The thread of each roller 426*r* may be longitudinally cut adjacent to ends thereof for forming pinions. The pinions may mesh with the respective ring gears 426*g*. The ring gears 426*g* and retainers 426*f* may be mounted to the roller nut 426*n*, such as by threaded fasteners. Each retainer 426*f* may also have a bracket portion for mounting of the roller nut 426*n* to the side of the counterweight box 410*b*.

Figure 18:
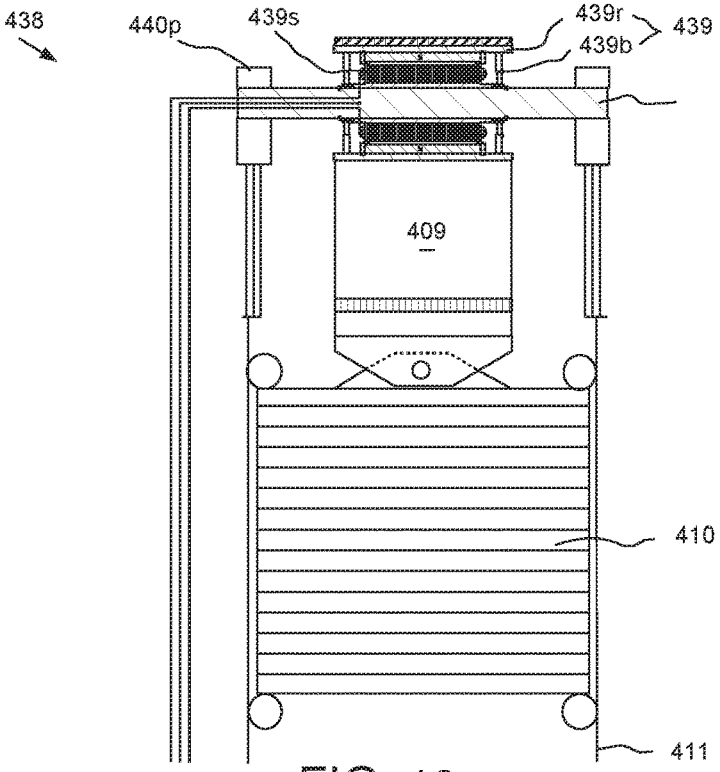
FIG. 18 illustrates an alternative dynamic counterbalance system utilizing an inside-out motor, according to another embodiment of the present disclosure.

FIG. 18 illustrates an alternative dynamic counterbalance system 438 utilizing an inside-out adjustment motor 439 instead of the adjustment motor 406*m* and linear actuator, according to another embodiment of the present disclosure. The alternative dynamic counterbalance system 438 may be used with the long stroke pumping unit 401*k* instead of the dynamic counterbalance system 406 and the drum assembly 408.

The alternative dynamic counterbalance system 438 may include the inside-out adjustment motor 439, a support rod 440*r*, and one or more (pair shown) pillow bocks 440*p* mounting the support rod to the crown. The inside-out adjustment motor 439 may include a stator 439*s* mounted to the support rod 440*r*, a rotor 439*r* encircling the stator for being torsionally driven thereby, and a bearing assembly 439*b*. The rotor 439*r* may include a housing made from a ferromagnetic material, such as steel, and a plurality of permanent magnets torsionally connected to the housing. The rotor 439*r* may include one or more pairs of permanent magnets having opposite polarities N,S. The permanent magnets may also be fastened to the housing, such as by retainers. The load belt 409 may extend from the counterweight assembly 410 upward to the inside-out adjustment motor 439, over an outer surface of the housing of the rotor 439*r*, and downward to the hanger bar 412.

The stator 439*s* may include a core and a plurality of coils, such as three (only two shown). The stator core may be made from a ferromagnetic material of low electrical conductivity (or dielectric), such as electrical steel or a soft magnetic composite. The stator core may have lobes formed therein, each lobe for receiving a respective coil. Each stator coil may include a length of wire wound onto the stator core 434 and having a conductor and a jacket. Each conductor may be made from an electrically conductive metal or alloy, such as aluminum, copper, aluminum alloy, or copper alloy. Each jacket may be made from a dielectric and nonmagnetic material, such as a polymer. Ends of each coil may be connected to a different pair of conductors of the power cable than adjacent coils thereto, thereby forming the three phases of the inside-out adjustment motor 439. Conductors of the power cable may extend to the stator coils via passages formed through the support rod 440*r*. The stator core may be mounted onto a sleeve of the bearing assembly 439*b* and the bearing sleeve may be mounted onto the support rod 440*r*. The bearing assembly 439*b* may support the rotor 439*r* for rotation relative to the stator 439*s*.

Alternatively, the inside-out adjustment motor 439 may be a switched reluctance motor instead of a brushless direct current motor.

Operation of the alternative dynamic counterbalance system may be similar to operation of the dynamic counterbalance system 406 except that the inside-out adjustment motor 439 exerts the adjustment force on the counterweight assembly 410 via the load belt 409.

Figure 19:
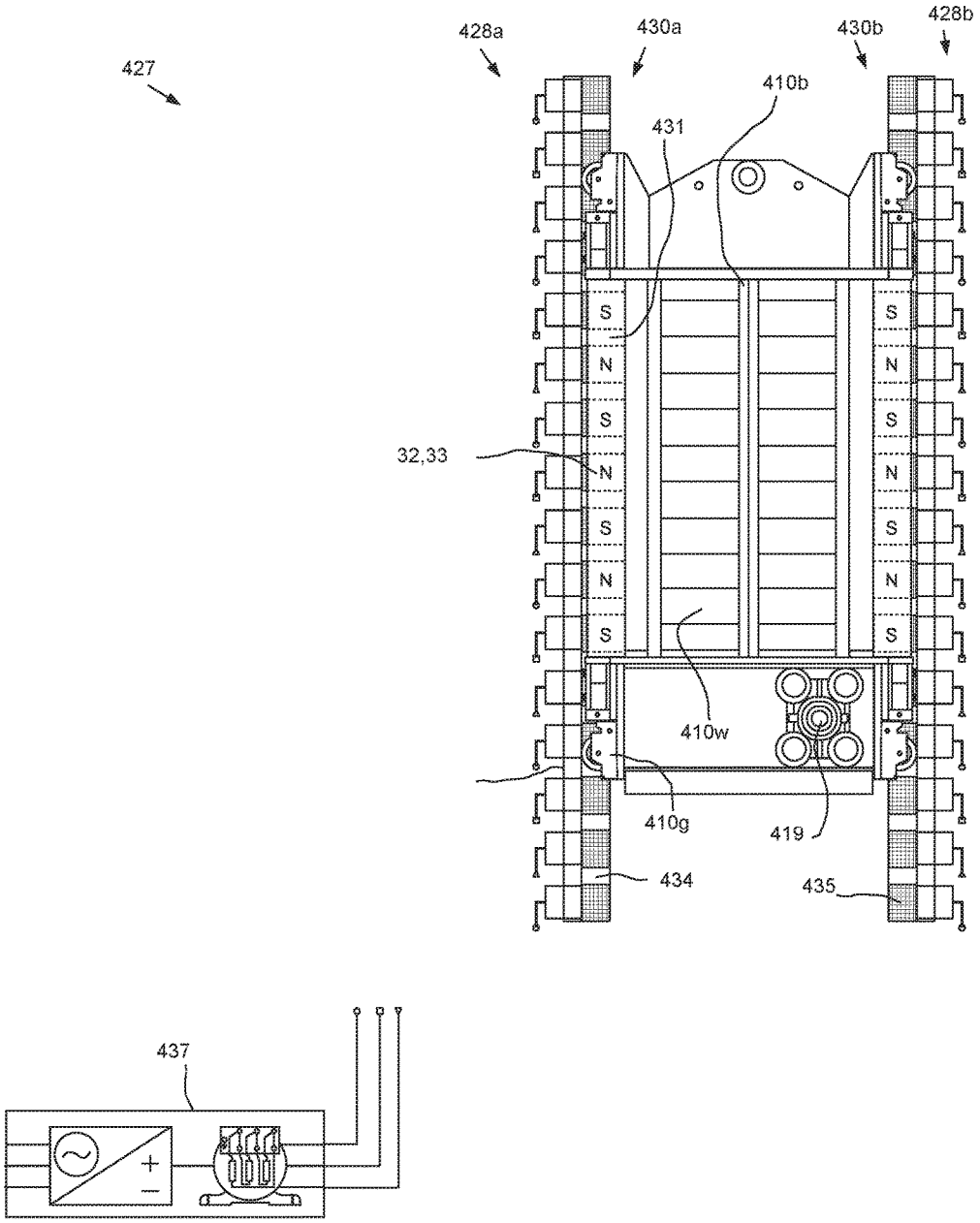
FIG. 19 illustrates an alternative dynamic counterbalance system utilizing a linear electromagnetic motor, according to another embodiment of the present disclosure.
Figure 20A:
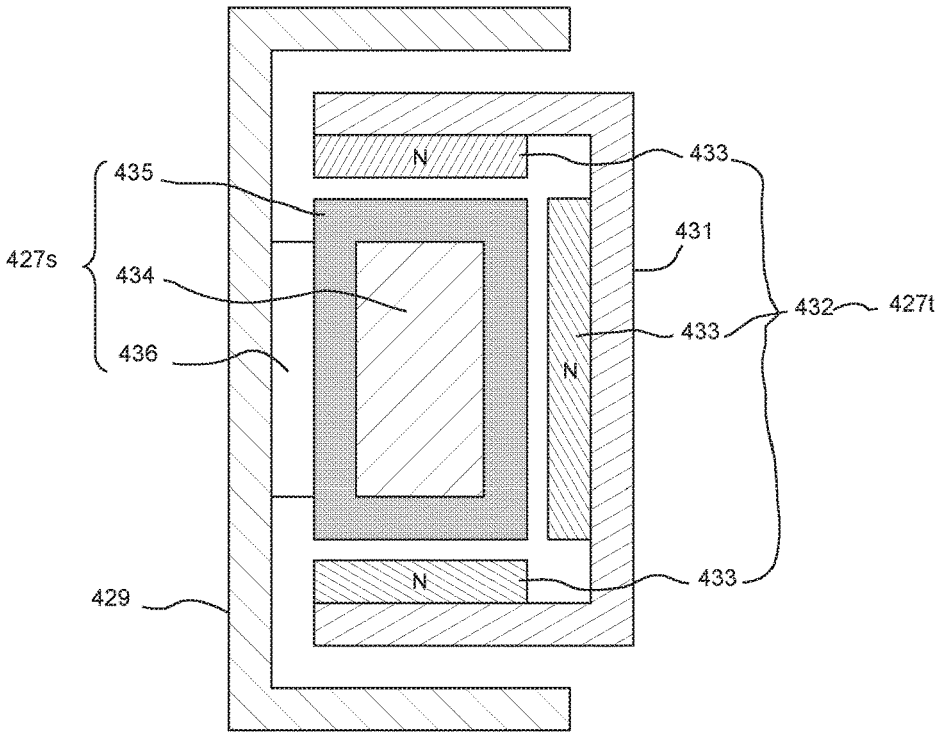
FIGS. 20A and 20B illustrate a traveler and stator of the linear electromagnetic motor.
Figure 20B:
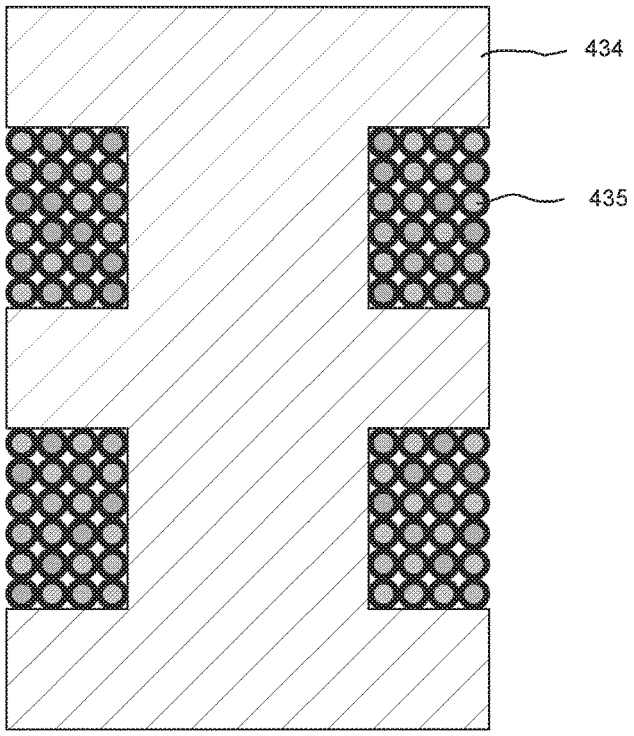

FIG. 19 illustrates an alternative dynamic counterbalance system utilizing a linear electromagnetic adjustment motor 427 instead of the rotary adjustment motor 406*m* and linear actuator, according to another embodiment of the present disclosure. FIGS. 20A and 20B illustrate a traveler 427*t* and stator 427*s* of the linear electromagnetic motor 427. The alternative dynamic counterbalance system may be used with the long stroke pumping unit 401*k* instead of the dynamic counterbalance system 406 and a variable force adjustment motor driver 437 may be used with the control system 415 to operate the linear electromagnetic motor 427 instead of the variable torque adjustment motor driver 415*a*.

The linear electromagnetic motor 427 may be a one or more, such as three, phase motor. The linear electromagnetic motor 427 may include the stator 427*s* and the traveler 427*t*. The stator 427*s* may include a pair of units 428*a,b*. Each stator unit 428*a,b* may extend between the crown 407 and the tower base 413 and have ends connected thereto. Each stator unit 428*a,b* may be housed within the respective guide rail 429 of the tower 411. The traveler 427*t* may also include a pair of units 430*a,b*. Each traveler unit 430*a,b* may be mounted to a respective side of the counterweight box 410*b*.

Each traveler unit 430*a,b* may include a traveler core 431 and a plurality of rows 432 of permanent magnets 433 connected to the traveler core, such as by fasteners (not shown). The traveler core 431 may be C-beam extending along the counterweight box 410*b* and be made from a ferromagnetic material, such as steel. Each row 432 may include a permanent magnet 433 connected to a respective inner face of the traveler core 431 such that the row surrounds three sides of the respective stator unit 428*a,b*. Each row 432 may be spaced along the traveler core 431 and each traveler unit 430*a,b* may include a sufficient number (seven shown) of rows to extend the length of the counterweight box 410*b*. A height of each row 432, defined by the height of the respective magnets 433, may correspond to a height of each coil 435 of the stator 427*s*. The polarization N,S of each row 432 may be oriented in the same cylindrically ordinate direction. Each adjacent row 432 may be oppositely polarized N,S.

Alternatively, the polarizations N,S of the rows 432 may be selected to concentrate the magnetic field of the traveler 427*t* at the periphery adjacent the stator 427*s* while canceling the magnetic field at an interior adjacent the traveler core 431 (aka Halbach array). Alternatively, the traveler core 431 may be made from a paramagnetic metal or alloy.

Each stator unit 428*a,b* may include a core 434, a plurality of coils 435, and a plurality of brackets 436. The stator core 434 may be a bar extending from the tower base 413 to the crown 407 and along the respective guide rail 429. The stator core 434 may have grooves spaced therealong for receiving a respective coil 435 and each stator unit 428*a,b* may have a sufficient number of coils for extending from the tower base 413 to the crown 407. The brackets may 436 may be disposed at each space between adjacent grooves in the stator core 434 and may fasten the stator core to the respective guide rail 429. The stator core 434 may be made from a ferromagnetic material of low electrical conductivity (or dielectric), such as electrical steel or soft magnetic composite. Each coil 435 may include a length of wire wound onto the stator core 434 and having a conductor and a jacket. Each conductor may be made from an electrically conductive metal or alloy, such as aluminum, copper, aluminum alloy, or copper alloy. Each jacket may be made from a dielectric and nonmagnetic material, such as a polymer. Ends of each coil 435 may be connected to a different pair of conductors of the power cable than adjacent coils thereto (depicted by the square, circle and triangle), thereby forming the three phases of the linear electromagnetic motor 427.

Alternatively, each stator core 434 may be a box instead of a bar.

Operation of the alternative dynamic counterbalance system may be similar to operation of the dynamic counterbalance system 406 except that the fifth act 425*e* of converting the adjustment force into adjustment torque is obviated by the adjustment motor being a linear electromagnetic motor 427 instead of the rotary adjustment motor 406*m* and the sixth act 425*f* may be simply instructing the variable force adjustment motor driver 437 to operate the linear electromagnetic adjustment motor 427 at the adjustment force.

Alternatively, the counterweight position may be determined by the adjustment motor driver 437 having a voltmeter and/or ammeter in communication with each phase. At any given time, the adjustment motor driver 437 may drive only two of the stator phases and may use the voltmeter and/or ammeter to measure back electromotive force (EMF) in the idle phase. The adjustment motor driver 437 may then use the measured back EMF from the idle phase to determine the position of the counterweight assembly 410.

Figure 21:
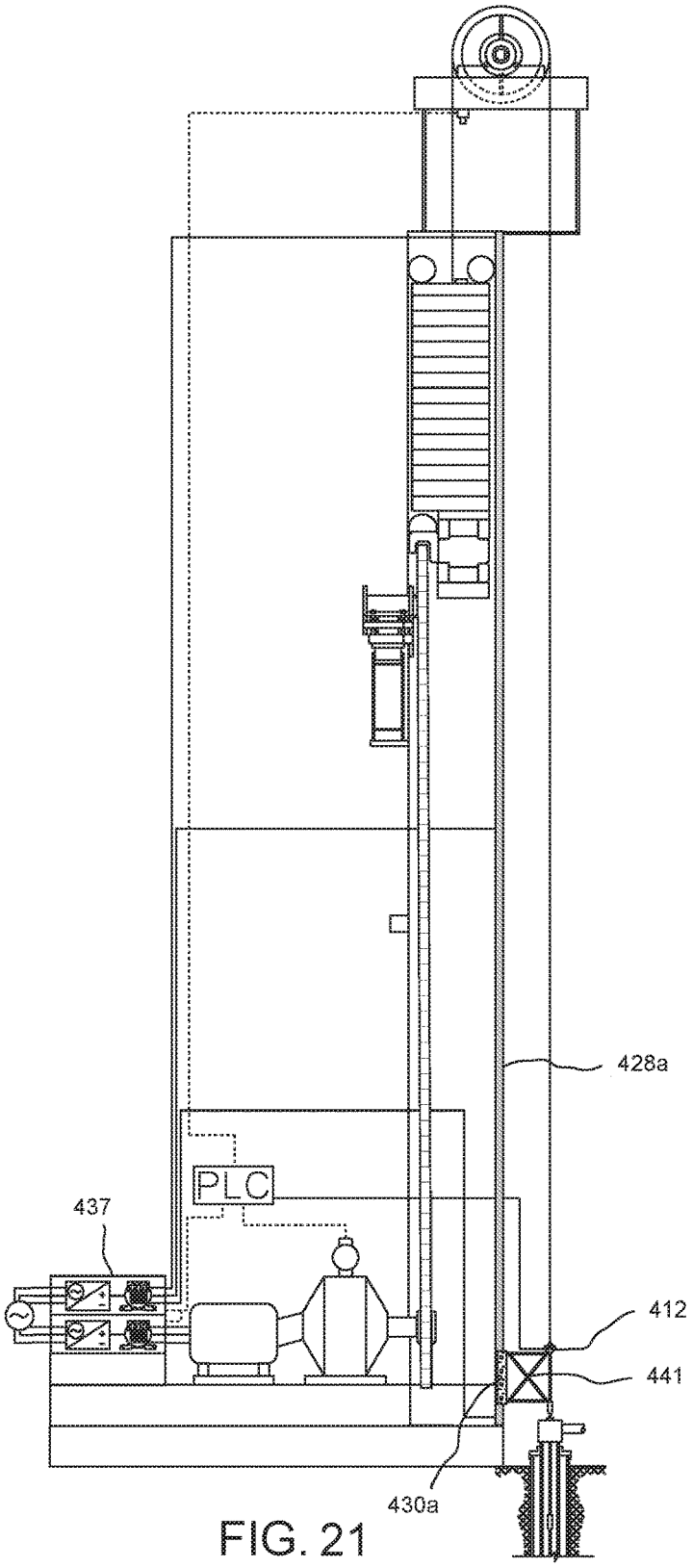
FIG. 21 illustrates another alternative dynamic counterbalance system utilizing a linear electromagnetic motor, according to another embodiment of the present disclosure.

FIG. 21 illustrates another alternative dynamic counterbalance system utilizing a linear electromagnetic adjustment motor 428*a*, 430*a*, according to another embodiment of the present disclosure. The alternative dynamic counterbalance system may be similar to the alternative dynamic counterbalance system utilizing the linear electromagnetic adjustment motor 427 except that the stator unit 428*b* and traveler unit 430*b* have been omitted, an outer guide rail has been added to the tower 411, the stator unit 428*a* is mounted to the outer guide rail, and the traveler unit 430*a* is mounted to the hanger bar 412 via frame 441.

Operation of the alternative dynamic counterbalance system may be similar to operation of the alternative dynamic counterbalance system utilizing the linear electromagnetic adjustment motor 427 except that the linear electromagnetic adjustment motor 428*a*, 430*a* exerts the adjustment force on the counterweight assembly 410 via the load belt 409. In addition to being able to handle failure of the rod string 401*r*, the PLC 415*p* may also detect failure of the load belt 409 by monitoring the rangefinder 415*t* and/or the load cell 415*d*. If failure of the load belt 409 is detected, the PLC 415*p* may instruct the motor drivers 415*c*, 437 to operate the respective motors 416, 428*a*, 430*a* to control the descent of the counterweight assembly 410 and the rod string 401*r* until the counterweight assembly reaches the tower base 413 and the polished rod 404*p* engages the stuffing box.

Alternatively, the control system 415 may further include a second mirror mounted to the frame 441 and a second laser rangefinder mounted to the crown 407 and aimed at the second mirror for sensing position of the hanger bar 412. Alternatively, any of the alternative counterweight position sensors discussed above may be added for sensing position of the hanger bar 412.

Figure 22A:
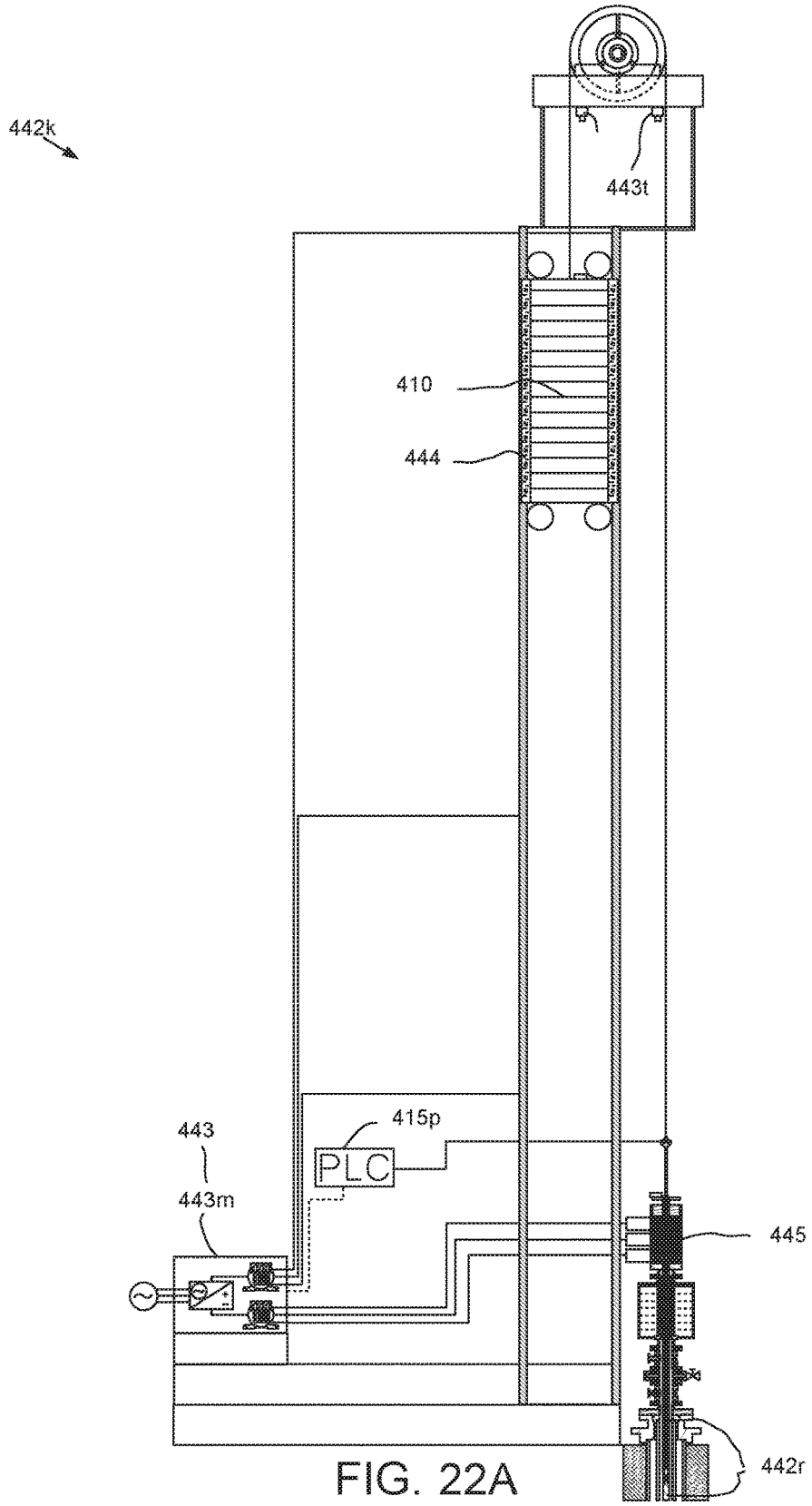
FIGS. 22A and 22B illustrates an alternative long stroke pumping unit, according to another embodiment of the present disclosure.
Figure 22B:
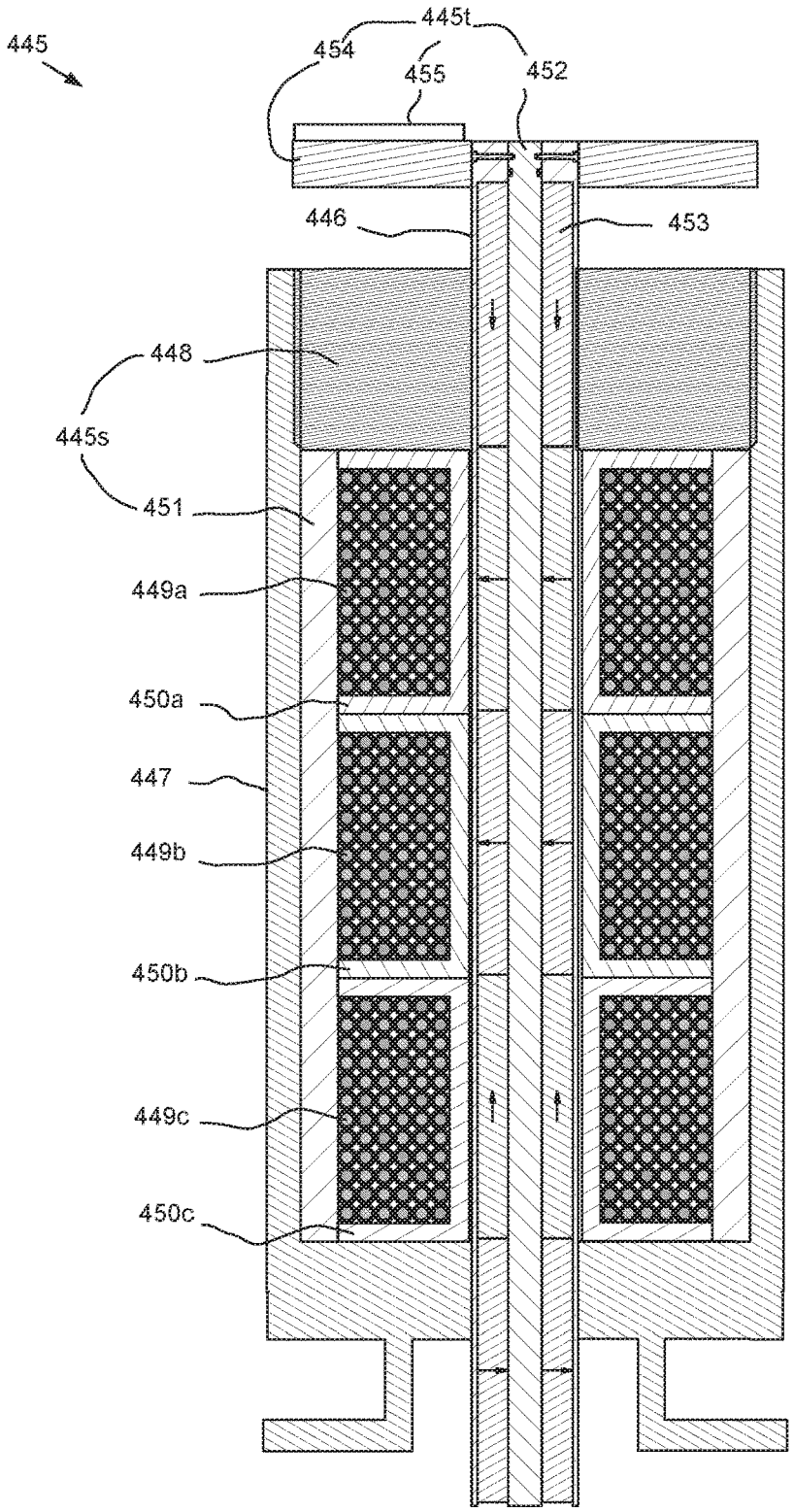

FIGS. 22A and 22B illustrates an alternative long stroke pumping unit 442*k*, according to another embodiment of the present disclosure. The alternative long stroke pumping unit 442*k* may include the skid 405, one or more ladders and platforms (not shown), a standing strut (not shown), the crown 407, the drum assembly 408, the load belt 409, one or more wind guards (not shown), the counterweight assembly 410, the tower 411, the hanger bar 412, the tower base 413, the foundation 414, a control system 443, a motor 444 for lifting the counterweight assembly, and a motor 445 for lifting a rod string 442*r*. The control system 443 may include the PLC 415*p*, a dual motor driver 443*m*, the laser rangefinder 415*t*, the load cell 415*d*, and a rod position sensor, such as second laser rangefinder 443*t*.

Alternatively, any of the alternative counterweight position sensors discussed above may be used instead of either or both laser rangefinders 415*t*, 443*t*. Alternatively, an application-specific integrated circuit (ASIC) or field-programmable gate array (FPGA) may be used as the controller in the control system 443 instead of the PLC 415*p*. Alternatively, the PLC 145*p* and the motor driver 443*m* may be combined into one physical control unit.

The counterweight motor 444 may be a linear electromagnetic motor similar to the linear electromagnetic motor 427. The dual motor driver 443*m* may be mounted to the skid 405 and be in electrical communication with the stator of the counterweight motor 444 via a power cable and be in electrical communication with a stator 445*s* of the rod motor 445 via a second power cable. Each power cable may include a pair of conductors for each phase of the respective motor 444, 445. The dual motor driver 443*m* may be variable speed including a rectifier and a pair of inverters. The dual motor driver 443*m* may receive the three phase alternating current (AC) power signal from the three phase power source. The rectifier may convert the three phase AC power signal to a direct current (DC) power signal and each inverter may modulate the DC power signal to drive each phase of the respective motor stator based on speed instructions from the PLC 415*p*.

The rod motor 445 may be a one or more, such as three, phase linear electromagnetic motor mounted to the wellhead 402*h*. The rod motor 445 may include the stator 445*s* and a traveler 445*t*. The stator 445*s* may be connected to an upper end of the stuffing box, such as by a flanged connection. The stuffing box, production tree, and wellhead 402*h* may be capable of supporting the stator 445*s* during lifting of the rod string 442*r* which may exert a considerable downward reaction force thereon. The traveler 445*t* may extend through the stuffing box and include a polished sleeve 446. The stuffing box may have a seal assembly for sealing against an outer surface of the polished sleeve 446 while accommodating reciprocation of the rod string 442*r* relative to the stuffing box.

Alternatively, the stator 445*s* may be connected between the stuffing box and the production tree or between the production tree and the wellhead 402*h*.

The stator 445*s* may include a housing 447, a retainer, such as a nut 448, a coil 449*a-c* forming each phase of the stator, a spool 450*a-c* for each coil, and a core 451. The housing 447 may be tubular, have a bore formed therethrough, have a flange formed at a lower end thereof for connection to the stuffing box, and have an inner thread formed at an upper end thereof. The nut 448 may be screwed into the threaded end of the housing 447, thereby trapping the coils 449*a-c*, spools 450*a-c*, and core 451 between a shoulder formed in an inner surface of the housing and in a stator chamber formed in the housing inner surface. Each coil 449*a-c* may include a length of wire wound onto a respective spool 450*a-c* and having a conductor and a jacket. Each conductor may be made from an electrically conductive metal or alloy, such as aluminum, copper, aluminum alloy, or copper alloy. Each jacket may be made from a dielectric material. Each spool 450*a-c* may be made from a material having low magnetic permeability or being non-magnetic. The stator core 451 may be made from a ferromagnetic material, such as steel. The coils 449*a-c* and spools 450*a-c* may be stacked in the stator chamber and the stator core 451 may be a sleeve extending along the stator chamber and surrounding the coils and spools.

Alternatively, the housing 447 may also have a flange formed at an upper end thereof or the nut 448 may have a flange formed at an upper end thereof.

The traveler 445*t* may include the polished sleeve 446, a core 452, permanent magnet rings 453, a clamp 454, and a mirror 455. The traveler core 452 may be a rod having a thread formed at a lower end thereof for connection to the sucker rod string 404*s*, thereby forming the rod string 442*r*. The traveler core 452 may be made from a ferromagnetic material, such as steel. The polished sleeve 446 may extend along the traveler core 452 and be made from a material having low magnetic permeability or being non-magnetic. Each end of the polished sleeve 446 may be connected to the traveler core 452, such as by one or more (pair shown) fasteners. The traveler core 452 may have seal grooves formed at or adjacent to each end thereof and seals may be disposed in the seal grooves and engaged with an inner surface of the polished sleeve 446. The polished sleeve 446 may have an inner shoulder formed in an upper end thereof and the traveler core 452 may have an outer shoulder formed adjacent to the lower threaded end. A magnet chamber may be formed longitudinally between the shoulders and radially between an inner surface of the polished sleeve 446 and an outer surface of the traveler core 452. The permanent magnet rings 453 may be stacked along the magnet chamber.

Each permanent magnet ring 453 may be unitary and have a height corresponding to a height of each coil 449*a-c*. The polarizations of the permanent magnet rings 453 may be selected to concentrate the magnetic field of the traveler 445*t* at the periphery adjacent the stator 445*s* while canceling the magnetic field at an interior adjacent the traveler core 452. A length of the stack of permanent magnet rings 453 may define a stroke length of the direct drive pumping unit 442*k* and the traveler 445*t* may include a sufficient number of permanent magnet rings to accommodate the long stroke of the pumping unit 442*k*. The clamp 454 may be fastened to an upper end of the polished sleeve 446 and may engage the nut 448 to serve as a stop during maintenance or installation of the long stroke pumping unit 442*k*. The mirror 455 may be mounted to the clamp 454 in a line of sight of the second laser rangefinder 443*t*.

Alternatively, each permanent magnet ring 453 may be made from a row of permanent magnet plates instead of being unitary. Alternatively, only the upper end of the polished sleeve 446 may be fastened to the traveler core 452. Alternatively, the traveler 445*t* may include a sleeve disposed between the permanent magnet rings for serving as the core instead of the rod.

In operation, during an upstroke of the rod string 442*r*, the rod motor 445 may be driven by the dual motor driver 443*m* to lift the rod string while power generated from the counterweight motor 444 is received by the rectifier to lessen demand on the three phase power source. Conversely, during the downstroke of the rod string 442*r*, the counterweight motor 444 may be driven by the dual motor driver 443*m* to lift the counterweight assembly 410 while power generated from the rod motor 445 is received by the rectifier to lessen demand on the three phase power source.

In addition to being able to handle failure of the rod string 442*r*, the PLC 415*p* may also detect failure of the load belt 409 by monitoring the rangefinder 443*t* and/or the load cell 415*d*. If failure of the load belt 409 is detected, the PLC 415*p* may instruct the dual motor driver 443*m* to operate the respective motors 444, 445 to control the descent of the counterweight assembly 410 and the rod string 442*r* until the counterweight assembly reaches the tower base 413 and the clamp 454 engages the stuffing box.

Alternatively, the rod motor 445 may be used with the alternative dynamic counterbalance system instead of the linear electromagnetic adjustment motor 428*a*, 430*a* or vice versa.

Alternatively, the prime mover and/or any of the rotary adjustment motors may be hydraulic motors instead of electric motors.

Alternatively, the dynamic counterbalance system 406 may further include a mechanical linkage, such as a synchronizer, between either sprocket 421, 422*k* or chain 420 and the screw shaft 424*s*.

In one embodiment, a long stroke pumping unit includes a tower; a counterweight assembly movable along the tower; a crown mounted atop the tower; a drum supported by the crown and rotatable relative thereto; a belt having a first end connected to the counterweight assembly, extending over the drum, and having a second end connectable to a rod string; a linear electromagnetic motor for reciprocating the counterweight assembly along the tower and having a traveler mounted to an exterior of the counterweight assembly and a stator extending from a base of the tower to the crown and along a guide rail of the tower; and a sensor for detecting position of the counterweight assembly.

In one or more of the embodiments described herein, the stator includes a core extending from a base of the tower to the crown and fastened to the guide rail; and coils spaced along the core, each coil having a length of wire wrapped around the core.

In one or more of the embodiments described herein, the traveler includes a core mounted to a side of the counterweight assembly; and permanent magnets spaced along the core.

In one or more of the embodiments described herein, the stator core is a bar or box.

In one or more of the embodiments described herein, the traveler core is a C-beam, and each permanent magnet is part of a row of permanent magnets surrounding three sides of the stator.

In one or more of the embodiments described herein, the stator core is made from electrical steel or a soft magnetic composite.

In one or more of the embodiments described herein, the traveler core is made from a ferromagnetic material.

In one or more of the embodiments described herein, the traveler comprises a pair of units mounted to a respective side of the counterweight assembly, the stator comprises a pair of units, and each stator unit extends from the tower to the crown and along a respective guide rail of the tower.

In one or more of the embodiments described herein, the unit includes a variable speed motor driver in electrical communication with the stator and in data communication with the sensor; and a controller in data communication with the motor driver and operable to control speed thereof.

In one or more of the embodiments described herein, the controller is further operable to monitor the sensor for failure of the rod string and instruct the motor driver to control descent of the counterweight assembly in response to detection of the failure.

In one or more of the embodiments described herein, the stator is three phase.

In one or more of the embodiments described herein, the sensor is a laser rangefinder, ultrasonic rangefinder, string potentiometer, or linear variable differential transformer (LVDT).

In another embodiment, a long stroke pumping unit includes a tower; a counterweight assembly movable along the tower; a crown mounted atop the tower; a drum supported by the crown and rotatable relative thereto; a belt having a first end connected to the counterweight assembly, extending over the drum, and having a second end connectable to a rod string; a linear electromagnetic motor for reciprocating the counterweight assembly along the tower and includes a traveler mounted in an interior of the counterweight assembly and a stator extending from a base of the tower to the crown and extending through the interior of the counterweight assembly; and a sensor for detecting position of the counterweight assembly.

In one or more of the embodiments described herein, the unit further includes a variable speed motor driver in electrical communication with the traveler and in data communication with the sensor; and a controller in data communication with the motor driver and operable to control speed thereof.

In one or more of the embodiments described herein, the controller is further operable to monitor the sensor for failure of the rod string and instruct the motor driver to control descent of the counterweight assembly in response to detection of the failure.

In one or more of the embodiments described herein, the unit includes a shaft connected to the drum and rotatable relative to the crown, wherein the sensor is a turns counter comprising a gear mounted to the shaft and a proximity sensor mounted to the crown.

In one or more of the embodiments described herein, the stator includes a rectangular core extending from the base to the crown; and rows of permanent magnets extending along the core, each row surrounding the core.

In one or more of the embodiments described herein, the traveler comprises a plurality of electrically conducting coil segments connected in series to form a coil.

In one or more of the embodiments described herein, each coil segment is rotated ninety degrees with respect to adjacent coil segments.

In one or more of the embodiments described herein, the stator is an inner stator, the linear electromagnetic motor further comprises an outer stator, the outer stator comprises segments surrounding the traveler, and each segment comprises a core extending from the base to the crown and permanent magnets extending along an inner surface thereof.

In one or more of the embodiments described herein, the stator includes a round core extending from the base to the crown; and permanent magnet rings surrounding the core and extending along the core.

In one or more of the embodiments described herein, the traveler includes a spool; a coil of wire wrapped around the spool; and a core sleeve surrounding the coil.

In one or more of the embodiments described herein, the stator is three phase.

In one or more of the embodiments described herein, the sensor is a laser rangefinder, ultrasonic rangefinder, string potentiometer, or linear variable differential transformer (LVDT).

In another embodiment, a linear electromagnetic motor for a direct drive pumping unit includes a stator having a tubular housing having a flange for connection to a stuffing box, a spool disposed in the housing, a coil of wire wrapped around the spool, and a core sleeve surrounding the coil; and a traveler having a core extendable through a bore of the housing and having a thread formed at a lower end thereof for connection to a sucker rod string, a polished sleeve for engagement with a seal of the stuffing box and connected to the traveler core to form a chamber therebetween, permanent magnet rings disposed in and along the chamber, each ring surrounding the traveler core.

In one or more of the embodiments described herein, the stator comprises three or more spools and coils stacked in the housing.

In one or more of the embodiments described herein, the motor further includes a position sensor disposed in and connected to the housing and operable to measure position of the traveler relative to the stator.

In one or more of the embodiments described herein, each magnet ring is polarized to concentrate a magnetic field of the traveler at a periphery thereof adjacent to the stator while canceling the magnetic field at an interior adjacent to the traveler core.

In one or more of the embodiments described herein, the motor includes a clamp fastened to an upper end of the polished sleeve for engagement with the stuffing box when the motor is shut off.

In one or more of the embodiments described herein, each of the spool and the polished sleeve is made from a material having a low magnetic permeability or being non magnetic.

In another embodiment, a direct drive pumping unit includes a linear electromagnetic motor described herein; a sensor operable to measure a position of the traveler relative to the stator; a variable speed motor driver in electrical communication with the traveler and in data communication with the sensor; and a controller in data communication with the motor driver and operable to control speed thereof.

In one or more of the embodiments described herein, the unit includes a power converter in electrical communication with the motor driver; and a battery in electrical communication with the power converter and operable to store electrical power generated by the linear electromagnetic motor during a down stroke of the pumping unit.

In another embodiment, a wellhead assembly for a direct drive pumping unit includes a linear electromagnetic motor mounted on the stuffing box by a flanged connection; the stuffing box mounted on a production tree by a flanged connection; and the production tree mounted on a wellhead by a flanged connection.

In another embodiment, a direct drive pumping unit includes a reciprocator for reciprocating a sucker rod string and having a tower for surrounding a wellhead, a polished rod connectable to the sucker rod string and having an inner thread open to a top thereof and extending along at least most of a length thereof, a screw shaft for extending into the polished rod and interacting with the inner thread, and a motor mounted to the tower, torsionally connected to the screw shaft, and operable to rotate the screw shaft relative to the polished rod; and a sensor for detecting position of the polished rod.

In one or more of the embodiments described herein, the reciprocator further comprises a thrust bearing supporting the screw shaft from the crown.

In one or more of the embodiments described herein, the reciprocator further comprises a torsional arrestor mountable to the wellhead for engagement with the polished rod to allow longitudinal movement of the polished rod relative to the wellhead and to prevent rotation of the polished rod relative to the wellhead.

In one or more of the embodiments described herein, the unit includes a controller in data communication with the sensor and operable to regularly briefly retract the torsional arrestor from the polished rod to allow rotation thereof by a fraction of a turn.

In one or more of the embodiments described herein, the motor is an electric three phase motor.

In one or more of the embodiments described herein, the unit includes a variable speed motor driver in electrical communication with the motor; and a controller in data communication with the motor driver and the sensor and operable to control speed thereof.

In one or more of the embodiments described herein, the unit includes a power converter in electrical communication with the motor driver; and a battery in electrical communication with the power converter and operable to store electrical power generated by the motor during a downstroke of the pumping unit.

In one or more of the embodiments described herein, the motor is a hydraulic motor.

In one or more of the embodiments described herein, the unit includes a hydraulic power unit (HPU) for driving the hydraulic motor; a variable choke valve connecting the HPU to the hydraulic motor; and a controller in communication with the variable choke valve and the sensor and operable to control speed of the hydraulic motor.

In one or more of the embodiments described herein, the includes a turbine-generator set; a manifold for selectively providing fluid communication among the HPU, the turbine-generator set, and the hydraulic motor; a power converter in electrical communication with the turbine-generator set; and a battery in electrical communication with the power converter and operable to store electrical power generated by the turbine-generator set during a downstroke of the pumping unit.

In one or more of the embodiments described herein, the screw shaft interacts with the inner thread by mating therewith.

In one or more of the embodiments described herein, the unit includes a raceway is formed between the inner thread and the screw shaft, and the reciprocator further comprises threaded rollers for being disposed in the raceway.

In one or more of the embodiments described herein, the unit includes a raceway is formed between the inner thread and the screw shaft, and the reciprocator further comprises balls for being disposed in the raceway.

In one or more of the embodiments described herein, the reciprocator further comprises a rod rotator operable to intermittently rotate the polished rod a fraction of a turn.

In another embodiment, a long stroke pumping unit includes a tower; a counterweight assembly movable along the tower; a crown mounted atop the tower; a belt having a first end connected to the counterweight assembly and having a second end connectable to a rod string; a prime mover for reciprocating the counterweight assembly along the tower; a sensor for detecting position of the counterweight assembly; a load cell for measuring force exerted on the rod string; a motor operable to adjust an effective weight of the counterweight assembly during reciprocation thereof along the tower; and a controller in data communication with the sensor and the load cell and operable to control the adjustment force exerted by the adjustment motor.

In one or more of the embodiments described herein, the motor is a rotary motor, the unit further comprises a linear actuator connecting the adjustment motor to the counterweight assembly, and the controller is operable to control the adjustment force by controlling a torque of the adjustment motor.

In one or more of the embodiments described herein, the motor is mounted to the crown.

In one or more of the embodiments described herein, the linear actuator includes a nut mounted to the counterweight assembly; and a screw shaft extending from a base of the tower to the crown and through the nut, wherein the motor is torsionally connected to the screw shaft and operable to rotate the screw shaft relative to the nut.

In one or more of the embodiments described herein, a raceway is formed between a thread of the nut and a thread of the screw shaft.

In one or more of the embodiments described herein, the unit includes balls disposed in the raceway.

In one or more of the embodiments described herein, the unit includes threaded rollers disposed in the raceway.

In one or more of the embodiments described herein, the unit includes a tensioner supporting the screw shaft from the crown; an upper thrust bearing connecting the screw shaft to the tensioner; and a lower thrust bearing connecting the screw shaft to a base of the tower.

In one or more of the embodiments described herein, each of the prime mover and the motor is an electric three phase motor.

In one or more of the embodiments described herein, the unit includes a variable torque or a variable force motor driver in electrical communication with the motor; and a variable speed motor driver in electrical communication with the prime mover, wherein the controller is in data communication with the motor drivers and is further operable to control speed of the prime mover.

In one or more of the embodiments described herein, the controller is further operable to monitor the sensor and load cell for failure of the rod string and instruct the motor drivers to control descent of the counterweight assembly in response to detection of the failure.

In one or more of the embodiments described herein, the sensor is a laser rangefinder, ultrasonic rangefinder, string potentiometer, or linear variable differential transformer (LVDT).

In one or more of the embodiments described herein, the unit includes a drive sprocket torsionally connected to the prime mover; an idler sprocket connected to the tower; a chain for orbiting around the sprockets; and a carriage for longitudinally connecting the counterweight assembly to the chain while allowing relative transverse movement of the chain relative to the counterweight assembly.

In one or more of the embodiments described herein, the motor is a linear electromagnetic motor having a traveler mounted either to an exterior of the counterweight assembly or to a hanger bar for connecting the belt to the rod string; and a stator extending from a base of the tower to the crown and along a guide rail of the tower.

In one or more of the embodiments described herein, the stator includes a core extending from a base of the tower to the crown and fastened to the guide rail; and coils spaced along the core, each coil having a length of wire wrapped around the core, and the traveler includes a core and permanent magnets spaced along the core.

In one or more of the embodiments described herein, the stator core is a bar or box, the traveler core is a C-beam, and each permanent magnet is part of a row of permanent magnets surrounding three sides of the stator.

In one or more of the embodiments described herein, the stator core is made from electrical steel or a soft magnetic composite, and the traveler core is made from a ferromagnetic material.

In one or more of the embodiments described herein, the unit includes a drum supported by the crown and rotatable relative thereto, wherein the belt extends over the drum.

In one or more of the embodiments described herein, the motor is an inside-out rotary motor, the inside-out rotary motor comprises an inner stator mounted to the crown and an outer rotor, the belt extends over a housing of the outer rotor, and the motor exerts the adjustment force on the counterweight assembly via the belt.

In one or more of the embodiments described herein, the controller is a programmable logic controller, application-specific integrated circuit, or field-programmable gate array.

In another embodiment, a long stroke pumping unit includes a tower; a counterweight assembly movable along the tower; a crown mounted atop the tower; a drum supported by the crown and rotatable relative thereto; a belt having a first end connected to the counterweight assembly, extending over the drum, and having a second end connectable to a rod string; a first motor operable to lift the counterweight assembly along the tower; a second motor operable to lift the rod string; and a controller for operating the second motor during an upstroke of the rod string and for operating the first motor during a downstroke of the rod string.

In one or more of the embodiments described herein, the unit includes a dual motor driver in electrical communication with each motor and operable to drive the second motor while receiving power from the first motor during the upstroke and operable to drive the first motor while receiving power from the second motor during the downstroke.

In one or more of the embodiments described herein, the second motor is a linear electromagnetic motor including a stator having a tubular housing having a flange for connection to a stuffing box, a spool disposed in the housing, a coil of wire wrapped around the spool, and a core sleeve surrounding the coil; and a traveler having a core extendable through a bore of the housing and having a thread formed at a lower end thereof for connection to a sucker rod, a polished sleeve for engagement with a seal of the stuffing box and connected to the traveler core to form a chamber therebetween, and permanent magnet rings disposed in and along the chamber, each ring surrounding the traveler core.

While the foregoing is directed to embodiments of the present disclosure, other and further embodiments of the disclosure may be devised without departing from the basic scope thereof, and the scope of the invention is determined by the claims that follow.

The invention claimed is:

1. A long stroke pumping unit, comprising:

a tower;

a counterweight assembly movable along the tower;

a crown mounted atop the tower;

a drum supported by the crown and rotatable relative thereto;

a belt having a first end connected to the counterweight assembly, extending over the drum, and having a second end connectable to a rod string;

a linear electromagnetic motor for reciprocating the counterweight assembly along the tower and comprising:

a traveler mounted to an exterior of and extending along and attached to a side of the counterweight assembly; and a stator extending from a base of the tower to the crown and along a guide rail of the tower; and a sensor for detecting position of the counterweight assembly.

2. The unit of claim 1, wherein the stator comprises:

a core extending from a base of the tower to the crown and fastened to the guide rail; and coils spaced along the core, each coil having a length of wire wrapped around the core.

3. The unit of claim 2, wherein the traveler comprises:

a core mounted to a side of the counterweight assembly; and permanent magnets spaced along the core.

4. The unit of claim 3, wherein the stator core is a bar or box.

5. The unit of claim 4, wherein:

the traveler core is a C-beam, and each permanent magnet is part of a row of permanent magnets surrounding three sides of the stator.

6. The unit of claim 3, wherein the traveler core is made from a ferromagnetic material.

7. The unit of claim 2, wherein the stator core is made from electrical steel or a soft magnetic composite.

8. The unit of claim 1, wherein:

the traveler comprises a pair of units mounted to a respective side of the counterweight assembly, the stator comprises a pair of units, and each stator unit extends from a base of the tower to the crown and along a respective guide rail of the tower.

9. The unit of claim 1, further comprising:

a variable speed motor driver in electrical communication with the stator and in data communication with the sensor; and a controller in data communication with the motor driver and operable to control speed thereof.

10. The unit of claim 9, wherein the controller is further operable to monitor the sensor for failure of the rod string and instruct the motor driver to control descent of the counterweight assembly in response to detection of the failure.

11. The unit of claim 1, wherein the stator is three phase.

12. The unit of claim 1, wherein the sensor is a laser rangefinder, ultrasonic rangefinder, string potentiometer, or linear variable differential transformer (LVDT).

13. A long stroke pumping unit, comprising:

a tower;

a counterweight assembly movable along the tower;

a crown mounted atop the tower;

a drum supported by the crown and rotatable relative thereto;

a belt having a first end connected to the counterweight assembly, extending over the drum, and having a second end connectable to a rod string;

a linear electromagnetic motor for reciprocating the counterweight assembly along the tower and comprising:

a traveler attached to an interior of the counterweight assembly; and a stator extending from a base of the tower to the crown and extending through the interior of the counterweight assembly; and a sensor for detecting position of the counterweight assembly.

14. The unit of claim 13, further comprising:

a variable speed motor driver in electrical communication with the traveler and in data communication with the sensor; and a controller in data communication with the motor driver and operable to control speed thereof.

15. The unit of claim 14, wherein the controller is further operable to monitor the sensor for failure of the rod string and instruct the motor driver to control descent of the counterweight assembly in response to detection of the failure.

16. The unit of claim 13, further comprising:

a shaft connected to the drum and rotatable relative to the crown, wherein the sensor is a turns counter comprising a gear mounted to the shaft and a proximity sensor mounted to the crown.

17. The unit of claim 13, wherein the stator comprises:

a rectangular core extending from the base to the crown; and rows of permanent magnets extending along the core, each row surrounding the core.

18. The unit of claim 17, wherein the traveler comprises a plurality of electrically conducting coil segments connected in series to form a coil.

19. The unit of claim 18, wherein each coil segment is rotated ninety degrees with respect to adjacent coil segments.

20. The unit of claim 19, wherein:

the stator is an inner stator, the linear electromagnetic motor further comprises an outer stator, the outer stator comprises segments surrounding the traveler, and each segment comprises a core extending from the base to the crown and permanent magnets extending along an inner surface thereof.

21. The unit of claim 13, wherein the stator comprises:

a round core extending from the base to the crown; and permanent magnet rings surrounding the core and extending along the core.

22. The unit of claim 21, wherein the traveler comprises:

a spool;

a coil of wire wrapped around the spool; and a core sleeve surrounding the coil.

23. The unit of claim 13, wherein the stator is three phase.

24. The unit of claim 13, wherein the sensor is a laser rangefinder, ultrasonic rangefinder, string potentiometer, or linear variable differential transformer (LVDT).

* * * * *